US007979017B2

(12) United States Patent
Tanaka et al.

(10) Patent No.: US 7,979,017 B2
(45) Date of Patent: Jul. 12, 2011

(54) IMAGE-BEARING MEMBER PROTECTING AGENT, PROTECTIVE LAYER FORMING DEVICE, IMAGE FORMING METHOD, IMAGE FORMING APPARATUS AND PROCESS CARTRIDGE

(75) Inventors: Shinya Tanaka, Sagamihara (JP); Hiroshi Nakai, Yokohama (JP); Kunio Hasegawa, Isehara (JP)

(73) Assignee: Ricoh Company, Ltd., Tokyo (JP)

( * ) Notice: Subject to any disclaimer, the term of this patent is extended or adjusted under 35 U.S.C. 154(b) by 50 days.

(21) Appl. No.: 12/485,364

(22) Filed: Jun. 16, 2009

(65) Prior Publication Data

US 2009/0311014 A1 Dec. 17, 2009

(30) Foreign Application Priority Data

Jun. 16, 2008 (JP) ..... 2008-156763

(51) Int. Cl.
*G03G 21/00* (2006.01)

(52) U.S. Cl. ..... 399/346

(58) Field of Classification Search ..... 399/159, 399/346, 324, 325; 430/126.2
See application file for complete search history.

(56) References Cited

U.S. PATENT DOCUMENTS

| | | | | |
|---|---|---|---|---|
| 3,501,294 | A | 3/1970 | Joseph | |
| 7,691,791 | B2 * | 4/2010 | Usami | 508/107 |
| 2006/0285897 | A1 * | 12/2006 | Sugiura et al. | 399/346 |
| 2007/0224528 | A1 | 9/2007 | Yamashita et al. | |
| 2008/0089726 | A1 | 4/2008 | Hatakeyama et al. | |
| 2008/0118286 | A1 | 5/2008 | Yamashita et al. | |
| 2008/0138132 | A1 | 6/2008 | Yamashita et al. | |
| 2008/0166643 | A1 * | 7/2008 | Bender et al. | 430/66 |
| 2008/0226365 | A1 | 9/2008 | Hatakeyama et al. | |
| 2008/0253801 | A1 | 10/2008 | Hatakeyama et al. | |
| 2009/0003853 | A1 | 1/2009 | Hatakeyama et al. | |
| 2009/0016769 | A1 | 1/2009 | Hatakeyama et al. | |
| 2009/0028618 | A1 | 1/2009 | Kabata et al. | |
| 2009/0196665 | A1 * | 8/2009 | Tanaka et al. | 399/346 |
| 2009/0232541 | A1 * | 9/2009 | Hatakeyama et al. | 399/111 |
| 2009/0279930 | A1 * | 11/2009 | Kabata et al. | 399/346 |
| 2009/0285613 | A1 * | 11/2009 | Nakai et al. | 399/346 |
| 2009/0290919 | A1 * | 11/2009 | Tanaka et al. | 399/346 |
| 2009/0290920 | A1 * | 11/2009 | Hatakeyama et al. | 399/346 |
| 2010/0034560 | A1 * | 2/2010 | Tanaka et al. | 399/123 |
| 2010/0034570 | A1 * | 2/2010 | Hatakeyama et al. | 399/346 |
| 2010/0150627 | A1 * | 6/2010 | Usami | 399/346 |
| 2010/0178073 | A1 * | 7/2010 | Kabata et al. | 399/111 |
| 2010/0183972 | A1 * | 7/2010 | Hasegawa et al. | 430/119.7 |
| 2010/0209143 | A1 * | 8/2010 | Nakai et al. | 399/123 |

FOREIGN PATENT DOCUMENTS

| | | | |
|---|---|---|---|
| EP | 0 810 492 | A2 | 12/1997 |
| EP | 1 790 711 | A1 | 5/2007 |
| JP | 51-22380 | | 7/1976 |
| JP | 08305169 | A * | 11/1996 |
| JP | 2002229329 | A * | 8/2002 |
| JP | 2006-350240 | | 12/2006 |
| JP | 2007-145993 | | 6/2007 |

* cited by examiner

*Primary Examiner* — Robert Beatty
(74) *Attorney, Agent, or Firm* — Dickstein Shapiro LLP

(57) ABSTRACT

An object of the present disclosure is to provide an image-bearing member protecting agent capable of preventing abrasion of an image-bearing member, filming on an image-bearing member, smearing of a charging member and leakage of toner. The image-bearing member protecting agent includes a fatty acid metal salt and boron nitride, wherein the boron nitride is crystals having an average diameter of 0.1 μm to 1.0 μm and forms secondary particles of a crystal aggregate having an average diameter of 3.0 μm to 14.0 μm.

17 Claims, 3 Drawing Sheets

IMAGE-BEARING MEMBER PROTECTING AGENT, PROTECTIVE LAYER FORMING DEVICE, IMAGE FORMING METHOD, IMAGE FORMING APPARATUS AND PROCESS CARTRIDGE

BACKGROUND OF THE INVENTION

1. Field of the Invention

The present invention relates to an image forming apparatus exemplified by a complex machine including at least one of a copier, a printer, a facsimile and a plotter; an image-bearing member protecting agent applied or attached onto the surface of an image bearing member of the image forming apparatus; a protective layer forming device which forms a protective layer on the surface of the image bearing member, using the image-bearing member protecting agent; an image forming method using the image-bearing member protecting agent; and a process cartridge used in the image forming apparatus.

2. Description of the Related Art

Conventionally, in electrophotographic image formation, a latent electrostatic image is formed on an image bearing member made, for example, of a photoconductive material, and charged toner particles are attached to this latent electrostatic image so as to form a visible image. The visible image formed with the toner particles is transferred onto a transfer medium such as paper, then fixed on the transfer medium utilizing heat, pressure, solvent gas, etc. and thus formed as an output image.

Methods for the image formation are broadly classified, according to how toner particles for image visualization are charged, into so-called two-component developing methods in which frictional charging effected by agitating and mixing toner particles and carrier particles is utilized, and so-called one-component developing methods in which toner particles are charged without using carrier particles.

Further, the one-component developing methods are classified into magnetic one-component developing methods and nonmagnetic one-component developing methods, according to whether or not magnetic force is utilized to keep toner particles on a developing roller.

Hitherto, in copiers, complex machines based upon the copiers, and the like for which high-speed processing capability and favorable image reproducibility are required, the two-component developing methods have been employed in many cases due to demands for stable chargeability of toner particles, stable charge rising properties of the toner particles, long-term stability of image quality, etc.; whereas in compact printers, facsimiles, etc. for which space saving, cost reduction and the like are required, the one-component developing methods have been employed in many cases.

Also, nowadays in particular, colorization of output images is progressing, and demands for increase in the quality of images and stabilization of image quality are increasing like never before.

For higher image quality, toners have been made smaller in average particle diameter, and particles of the toners have been made rounder in shape with their angular parts removed.

Generally, in an image forming apparatus which operates in accordance with any such electrophotographic image forming method, regardless of which developing method is employed, a drum-shaped or belt-shaped image bearing member (typified by a photoconductor) is uniformly charged while being rotated, a latent image pattern is formed on the image bearing member by laser light or the like, and the latent image pattern is visualized as a toner image by a developing device and transferred onto a transfer medium.

After the toner image has been transferred onto the transfer medium, untransferred toner components remain on the image bearing member. If such residues are directly conveyed to a place for the charging step, it often hinders the image bearing member from being uniformly charged; accordingly, in general, the toner components, etc. remaining on the image bearing member are removed by a cleaning step after the transfer step, thereby bringing the surface of the image bearing member into a clean enough state, and then charging is carried out.

Thus, there are various types of physical stress and electrical stress in each step in image formation, which degrade the image bearing member, charging member(s) and cleaning member(s).

In attempts to solve this problem, a number of proposals for lubricants and methods of supplying lubricant components and forming films have been made thus far to reduce degradation of image bearing members, charging members and cleaning members.

For example, Japanese Patent Application Publication (JP-B) No. 51-22380 proposes a method of forming a lubricant film on a photoconductor surface by supplying the photoconductor surface with a solid lubricant composed mainly of zinc stearate in order to lengthen the lifetimes of the photoconductor and a cleaning blade. This makes it possible to reduce abrasion of the photoconductor surface and thus lengthen the lifetime of the photoconductor.

However, it is understood that fatty acid metal salts such as zinc stearate lose their lubricating properties at an early stage due to electric discharge performed in the vicinity of the image bearing member in a charging step. Consequently, lubricating properties between the cleaning blade and the image bearing member are impaired, causing toner leakage, and thus defective images are formed.

In an attempt to solve this problem, Japanese Patent Application Laid-Open (JP-A) No. 2006-350240 proposes a method of applying an image-bearing member protecting agent which contains a fatty acid metal salt and boron nitride. This makes it possible to maintain lubricating properties between a cleaning blade and an image bearing member by means of a lubricating effect of the boron nitride even under the influence of electric discharge performed in the vicinity of the image bearing member in a charging step, and toner leakage can be thereby prevented.

In JP-A No. 2007-145993, at least two types of higher fatty acid metal salts having different numbers of carbon atoms are used in order to improve the formability of an image-bearing member protecting agent with a large aspect ratio.

BRIEF SUMMARY OF THE INVENTION

However, when boron nitride is used for the image-bearing member protecting agent as described in JP-A No. 2006-350240, its high lubricating properties make it difficult to remove the agent from the surface of the image bearing member, and thus the agent is attached onto the image bearing member as a film, which causes blurring of an image.

In the method of JP-A No. 2007-145993, although the formability of the image-bearing member protecting agent is improved, the use of the different types of fatty acid metal salts causes a reduction in lubricating property, thereby worsening toner leakage and smearing of charging member(s).

The present invention is designed in light of the problems in the present situations, and an object of the present invention is to provide an image-bearing member protecting agent capable of preventing abrasion of an image bearing member, filming on the image bearing member, smearing of a charging member and leakage of toner.

Another object of the present invention is to provide a protective layer forming device capable of favorably forming a protective layer on the surface of the image bearing member, using the image-bearing member protecting agent.

Yet another object of the present invention is to provide an image forming method and an image forming apparatus which are capable of obtaining images of excellent quality in a stable manner over a long period of time.

Still yet another object of the present invention is to provide a process cartridge capable of obtaining images of excellent quality in a stable manner.

Disclosed embodiments include an image-bearing member protecting agent used in an image forming method which includes applying or attaching the agent onto a surface of an image bearing member, the agent including: a fatty acid metal salt and boron nitride, wherein the boron nitride includes secondary particles composed of aggregated fine crystals, and wherein the boron nitride crystals have an average primary particle diameter of 0.1 μm to 1.0 μm and form secondary particles of a crystal aggregate having an average secondary particle diameter of 3.0 μm to 14.0 μm.

In one example embodiment, the fatty acid metal salt is zinc stearate.

Another disclosed embodiment includes a protective layer forming device which applies or attaches an image-bearing member protecting agent of the example embodiments onto a surface of an image bearing member.

The protective layer forming device according to an example embodiment includes a supply member, via which the image-bearing member protecting agent is supplied onto the surface of the image bearing member.

The protective layer forming device according to another example embodiment includes a layer forming member by which the image-bearing member protecting agent supplied onto the surface of the image bearing member is pressed against the surface and formed into a film.

Another disclosed embodiment includes an image forming method including: transferring a toner image borne on an image bearing member onto a transfer medium by means of a transfer device, and applying or attaching an image-bearing member protecting agent of the example embodiments onto a surface of the image bearing member by means of a protective layer forming device after the toner image has been transferred onto the transfer medium.

An image forming apparatus including: an image bearing member which bears a toner image, a transfer device configured to transfer the toner image borne on the image bearing member onto a transfer medium, and a protective layer forming device of the example embodiments configured to apply or attach an image-bearing member protecting agent onto a surface of the image bearing member after the toner image has been transferred onto the transfer medium.

In one example embodiment, the image forming apparatus further includes a cleaning device placed on a downstream side of the transfer device and on an upstream side of the protective layer forming device with respect to the rotational direction of the image bearing member and configured to remove toner which remains on the surface of the image bearing member from the surface by rubbing against the surface.

In one example embodiment of the image forming apparatus, at least a layer formed as the outermost surface of the image bearing member contains a thermosetting resin.

In one example embodiment of the image forming apparatus, the image bearing member is a photoconductor.

In one example embodiment, the image forming apparatus further includes a charging device placed in contact with or close to the surface of the image bearing member.

In one example embodiment, the image forming apparatus further includes a voltage applying device configured to apply to the charging device a voltage which includes an alternating-current component.

In one example embodiment of the image forming apparatus, the image bearing member is an intermediate transfer medium.

In one example embodiment of the image forming apparatus, a circularity SR of the toner, represented by Equation 1, is in the range of 0.93 to 1.00.

$$\text{Circularity SR} = \text{Circumferential length of circle having the same area as projected particle area} / \text{Circumferential length of projected particle image} \quad \text{(Equation 1)}$$

In one example embodiment of the image forming apparatus, a ratio $D_4/D_1$ of a weight average particle diameter $D_4$ of the toner to a number average particle diameter $D_1$ of the toner is in the range of 1.00to 1.40.

Another disclosed embodiment includes a process cartridge including: an image bearing member which bears a toner image, and a protective layer forming device of the example embodiments provided integrally with the image bearing member and configured to apply or attach an image-bearing member protecting agent onto a surface of the image bearing member after the toner image has been transferred onto a transfer medium.

In one example embodiment, the process cartridge further includes a cleaning device placed on an upstream side of the protective layer forming device with respect to the rotational direction of the image bearing member and configured to remove toner which remains on the surface of the image bearing member from the surface by rubbing against the surface.

In one example embodiment of the process cartridge apparatus, at least a layer formed as the outermost surface of the image bearing member contains a thermosetting resin.

In one example embodiment, the process cartridge further includes a charging device placed in contact with or close to the surface of the image bearing member.

In one example embodiment of the process cartridge apparatus, a circularity SR of the toner, represented by Equation 1, is in the range of 0.93 to 1.00.

$$\text{Circularity SR} = \text{Circumferential length of circle having the same area as projected particle area} / \text{Circumferential length of projected particle image} \quad \text{(Equation 1)}$$

In one example embodiment of the process cartridge apparatus, a ratio $D_4/D_1$ of a weight average particle diameter $D_4$ of the toner to a number average particle diameter $D_1$ of the toner is in the range of 1.00to 1.40.

Another disclosed embodiment includes an image forming apparatus including the process cartridge according to any one of the example embodiments.

According to the present invention, it is possible to prevent abrasion of an image bearing member, filming on the image bearing member, smearing of a charging member and leakage of toner and to enhance image quality.

DETAILED DESCRIPTION OF THE INVENTION

Figure 1:
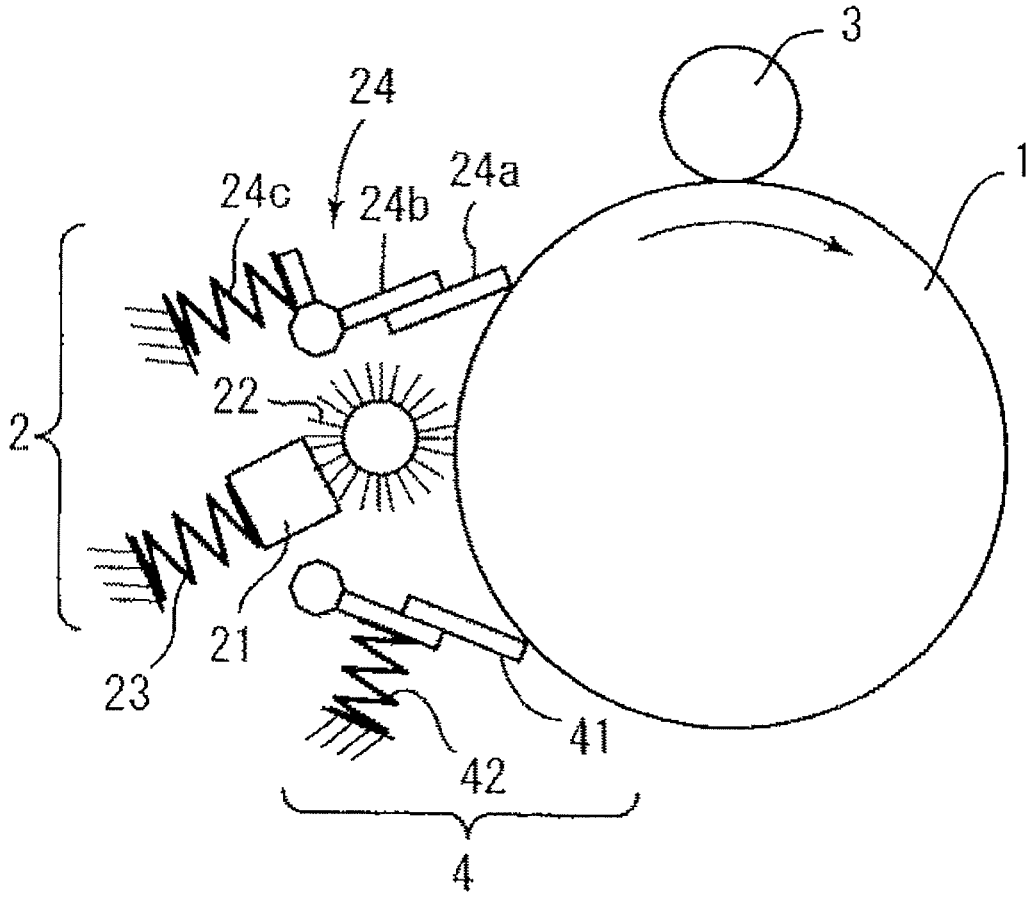
FIG. 1 is a schematic structural drawing of a protective layer forming device according to an embodiment of the present invention.

The following explains an embodiment of the present invention, referring to the drawings.

FIG. 1 is a schematic structural drawing of a protective layer forming device 2 according to the present embodiment. The protective layer forming device 2 placed facing a photoconductor drum (image bearing member) 1 which serves as an image bearing member is composed mainly of an image-bearing member protecting agent (hereinafter also referred to as "protecting agent" or "agent" for short) 21 which has been formed into the shape of a pillar or lever, a protecting agent supply member 22 as a supply member, a pressing force providing mechanism 23, a protective layer forming mechanism 24, etc.

The protective layer forming mechanism 24 includes a blade 24*a* which is in contact with the photoconductor drum 1 in a non-counter direction, a blade support 24*b* which supports the blade 24*a*, and a biasing unit 24*c* which biases the blade 24*a* together with the blade support 24*b* toward the photoconductor drum 1.

Although coil springs are used for the pressing force providing mechanism 23 and the biasing unit of the protective layer forming mechanism 24 in the present embodiment, the coil springs do not necessarily have to be used, and members having rubber elasticity, leaf springs or other elastic members may be used instead, for example.

The image-bearing member protecting agent 21 is brought into contact with the protecting agent supply member 22 in the form of a rotary brush by the pressing force of the pressing force providing mechanism 23. The protecting agent supply member 22 rotates at a linear velocity different from that of the image bearing member 1 and rubs on the surface of the image bearing member 1; at this time, an image-bearing member protecting agent held on the surface of the protecting agent supply member 22 is supplied onto the surface of the image bearing member.

The image-bearing member protecting agent supplied onto the surface of the image bearing member is formed into a thin layer (film) by the protective layer forming mechanism 24.

An image-bearing member protecting agent which has degraded is removed by an ordinary cleaning mechanism along with other components such as toner remaining on the image bearing member. The protective layer forming device 2 may function also as the cleaning mechanism; however, since the function of removing residual matter on the surface of the image bearing member and the function of forming a protective layer often require different appropriate rubbed states of a member, these functions are separated from each other in the present embodiment, and a cleaning device 4 is provided on the downstream side of an after-mentioned transfer device and on the upstream side of the protective layer forming device 2 with respect to the rotational direction of the photoconductor drum 1 as shown in FIG. 1.

The cleaning device 4 is composed of a cleaning blade 41 as a cleaning member, a cleaning pressing mechanism 42, etc. Although a coil spring is used for the cleaning pressing mechanism 42 in this embodiment, the coil spring does not necessarily have to be used, and a member having rubber elasticity, a leaf spring or other elastic member may be used instead, for example.

The agent 21 according to the present embodiment includes a fatty acid metal salt and boron nitride as its essential components. The boron nitride includes secondary particles composed of aggregated fine crystals, and the crystals have an average primary particle diameter of 0.1 μm to 1.0 μm and an average secondary particle diameter of 3.0 μm to 14.0 μm. The average primary particle diameter refers to the diameter of boron nitride crystals. The average secondary particle diameter refers to the particle diameter of aggregated boron nitride crystals. In other words, boron nitride crystals of an average primary particle diameter form secondary particles of a crystal aggregate having an average secondary particle.

Examples of the fatty acid metal salt include, but are not limited to, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate, cadmium ricinoleate and zinc laurate. Also, these substances may be used in combination.

The material of a blade 24*a* used for the protective layer forming mechanism 24 is not particularly limited, and examples of the material include elastic materials such as urethane rubber, hydrin rubber, silicone rubber and fluorine rubber, which are generally known as materials for cleaning blades. These elastic materials may be used individually or in a blended manner. Additionally, a portion of such a rubber blade which comes into contact with the image bearing member may be coated or impregnated with a low friction coefficient material. Further, in order to adjust the hardness of the elastic material used, a filling material such as an organic or inorganic filler may be dispersed.

Such a blade is fixed to a blade support 24*b* by a method such as adhesion or fusion bonding so that an end of the blade can be pressed onto the surface of the image bearing member. Although the thickness of the blade cannot be unequivocally defined because the thickness is decided in view of the force applied when the blade is pressed, preference is generally given to approximately 0.5 mm to 5 mm, and greater preference is given to approximately 1 mm to 3 mm.

Similarly, although the length of the blade which protrudes from the blade support 24*b* and may bend (so-called free length) cannot be unequivocally defined because the length is decided in view of the force applied when the blade is pressed, preference is generally given to approximately 1 mm to 15 mm, and greater preference is given to approximately 2 mm to 10 mm.

Another structure of a blade member for forming a protective layer may be employed in which a layer of a resin, rubber, elastomer, etc. is formed over a surface of an elastic metal blade such as a spring plate, using a coupling agent, a primer component, etc. if necessary, by a method such as coating or dipping, then subjected to thermal curing, etc. if necessary, and further, subjected to surface polishing, etc. if necessary.

As for the thickness of the elastic metal blade, preference is given to approximately 0.05 mm to 3 mm, and greater preference is given to approximately 0.1 mm to 1 mm.

In order to prevent the elastic metal blade from being twisted, the blade may, for example, be bent in a direction substantially parallel to a support shaft after the installation of the blade.

As the material for the layer over the surface, a fluorine resin such as PFA, PTFE, FEP or PVDF, a fluorine-based rubber, a silicone-based elastomer such as methylphenyl silicone elastomer, or the like may be used with the addition of a filler if necessary. However, the material is not limited thereto.

The force with which the image bearing member is pressed by the protective layer forming mechanism 24 is sufficient as long as it allows the image-bearing member protecting agent to spread and form into a protective layer or a protective film. The force is preferably in the range of 5 gf/cm to 80 gf/cm, more preferably in the range of 10 gf/cm to 60 gf/cm, as a linear pressure.

A brush-like member is preferably used as the protecting agent supply member 22; in this case, brush fibers of the brush-like member preferably have flexibility to reduce mechanical stress on the surface of the image bearing member.

As the material for the flexible brush fibers, one or more generally known materials may be used. Specifically, resins having flexibility among the following materials may be used: polyolefin resins (e.g. polyethylene and polypropylene); polyvinyl resins and polyvinylidene resins (e.g. polystyrene, acrylic resins, polyacrylonitrile, polyvinyl acetate, polyvinyl alcohol, polyvinyl butyral, polyvinyl chloride, polyvinyl carbazole, polyvinyl ethers and polyvinyl ketones); vinyl chloride-vinyl acetate copolymers; styrene-acrylic acid copolymers; styrene-butadiene resins; fluorine resins (e.g. polytetrafluoroethylene, polyvinyl fluoride, polyvinylidene fluoride and polychlorotrifluoroethylene); polyesters; nylons; acrylics; rayon; polyurethanes; polycarbonates; phenol resins; amino resins (e.g. urea-formaldehyde resins, melamine resins, benzoguanamine resins, urea resins and polyamide resins); and so forth.

To adjust the extent to which the brush bends, diene-based rubber, styrene-butadiene rubber (SBR), ethylene propylene rubber, isoprene rubber, nitrile rubber, urethane rubber, silicone rubber, hydrin rubber, norbornene rubber and the like may be used in combination.

A support for the protecting agent supply member 22 may be a stationary support or a roll-like rotatable support. The roll-like support for the supply member is exemplified by a roll brush formed by spirally winding a tape with a pile of brush fibers around a metal core. Each brush fiber preferably has a diameter of approximately 10 μm to 500 μm and a length of 1 mm to 15 mm, and the number of the brush fibers is preferably 10,000 to 300,000 per square inch ($1.5\times10^7$ to $4.5\times10^8$ per square meter).

For the protecting agent supply member 22, use of a material having a high brush fiber density is highly desirable in terms of uniformity and stability of the supply; for example, it is desirable that one fiber be formed from several to several hundreds of fine fibers. More specifically, 50 fine fibers of 6.7 decitex (6 denier) may be bundled together and planted as one fiber, as exemplified by the case of 333 decitex=6.7 decitex× 50 filaments (300 denier=6 denier×50 filaments).

Additionally, if necessary, the brush surface may be provided with a coating layer for the purpose of stabilizing the shape of the brush surface, the environment, etc. As constituent(s) of the coating layer, use of constituent(s) capable of deforming in a manner that conforms to the bending of the brush fibers is preferable, and the constituent(s) is/are not limited in any way as long as it/they can maintain its/their flexibility. Examples of the constituent(s) include polyolefin resins such as polyethylene, polypropylene, chlorinated polyethylene and chlorosulfonated polyethylene; polyvinyl resins and polyvinylidene resins, such as polystyrene, acrylics (e.g. polymethyl methacrylate), polyacrylonitrile, polyvinyl acetate, polyvinyl alcohol, polyvinyl butyral, polyvinyl chloride, polyvinyl carbazole, polyvinyl ethers and polyvinyl ketones; vinyl chloride-vinyl acetate copolymers; silicone resins including organosiloxane bonds, and modified products thereof (e.g. modified products made of alkyd resins, polyester resins, epoxy resins, polyurethanes, etc.); fluorine resins such as perfluoroalkyl ethers, polyfluorovinyl, polyfluorovinylidene and polychlorotrifluoroethylene; polyamides; polyesters; polyurethanes; polycarbonates; amino resins such as urea-formaldehyde resins; epoxy resins; and combinations of these resins.

Figure 2:
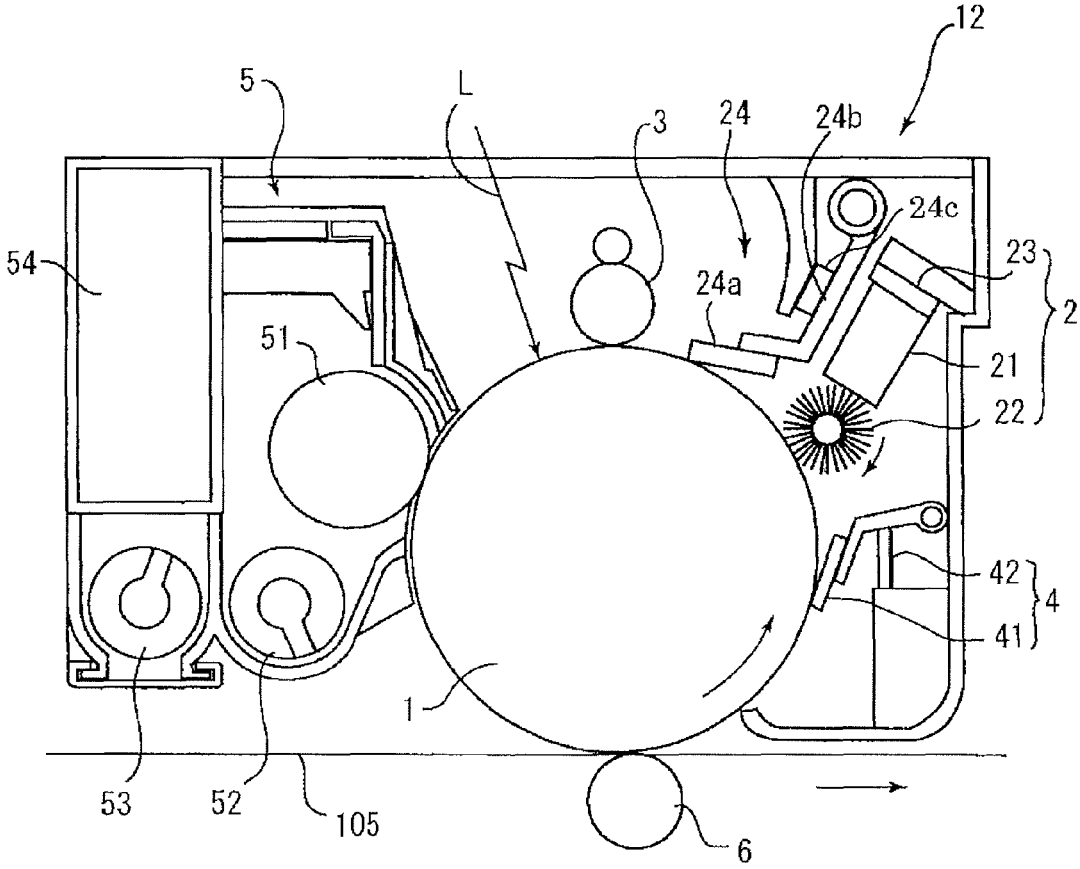
FIG. 2 is a schematic cross-sectional view of a process cartridge including the protective layer forming device shown in FIG. 1.

FIG. 2 is a cross-sectional view schematically showing a structural example of a process cartridge using the protective layer forming device 2.

In a process cartridge 12, the following are integrally housed: a photoconductor drum 1, the protective layer forming device 2, a charging roller 3, a developing device 5, a cleaning device 4 and the like. The developing device 5 includes a developing roller 51, conveying screws 52 and 53 which circulate a developer while agitating and conveying the developer, a preset case 54 which houses toner, and the like.

Toner components, an image-bearing member protecting agent which has partially degraded, etc. remain on the surface of the photoconductor drum 1 after a transferring step; such residual matter on the surface is cleaned off by a cleaning blade 41.

The cleaning blade 41 is in contact with the photoconductor drum 1 at an angle related to a so-called counter type (reading type).

The image-bearing member protecting agent 21 is supplied from the protecting agent supply member 22 onto the surface of the photoconductor drum 1 from which the residual toner, the image-bearing member protecting agent having degraded and the like have been removed by the cleaning device 4, and a protective layer in the form of a film is formed by the protective layer forming mechanism 24.

The photoconductor drum 1 on which the protective layer has been formed by the protective layer forming device 2 is charged, then a latent electrostatic image is formed on the photoconductor drum 1 by means of an exposure beam L exemplified by a laser beam. The latent electrostatic image is developed by the developing device 5 and thusly visualized as a toner image, and the toner image is transferred onto an intermediate transfer belt 105 serving as a transfer medium by a transfer roller 6 or the like serving as a transfer device placed outside the process cartridge 12. In the case of direct transfer, the transfer medium is a sheet-like recording medium.

Figure 3:
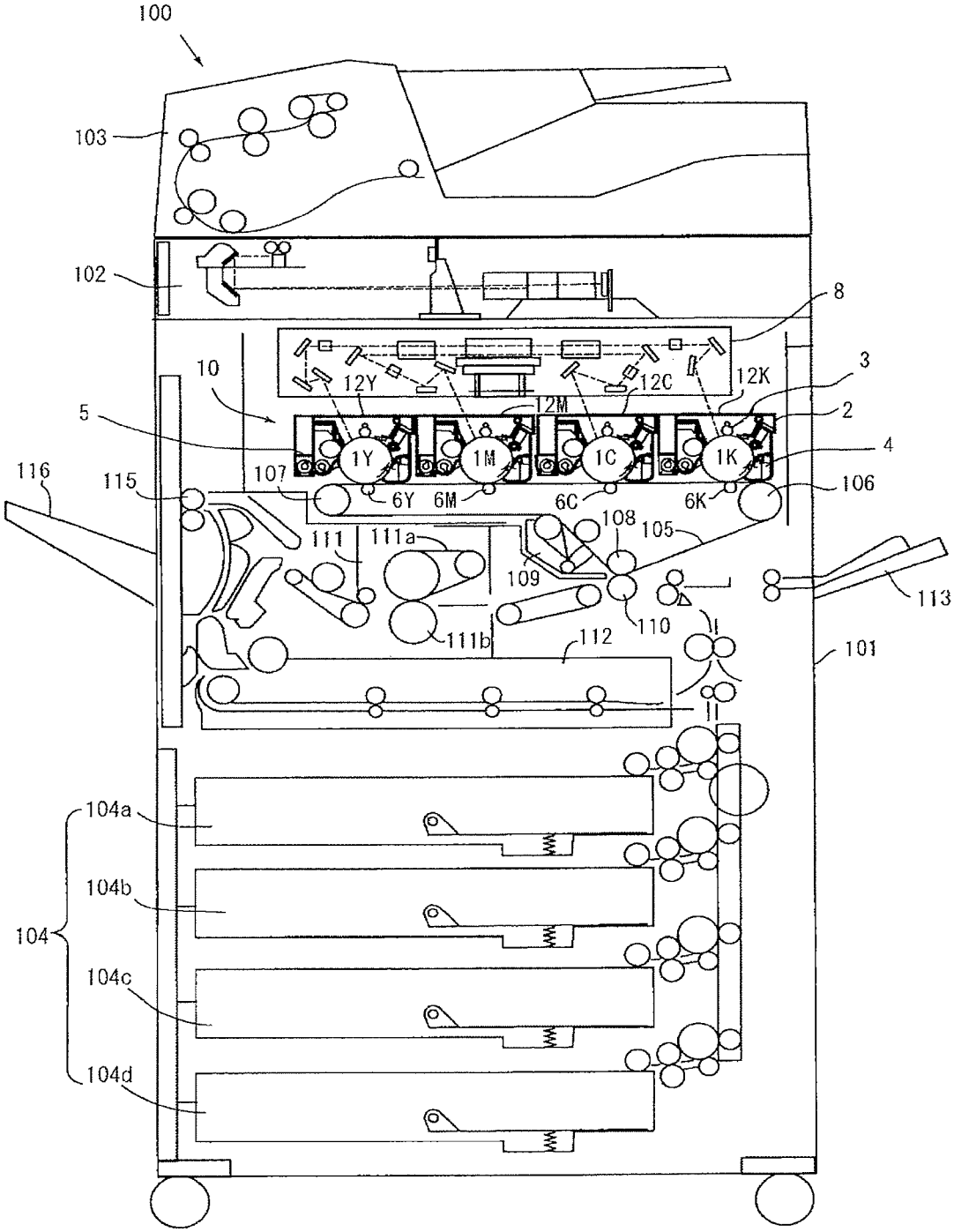
FIG. 3 is a schematic cross-sectional view of a color copier as an image forming apparatus.

FIG. 3 is a cross-sectional view showing an example of a color copier 100, which employs a tandem-type intermediate transfer method, serving as an image forming apparatus and including the protective layer forming device 2.

The color copier 100 includes an apparatus main body 101, a scanner 102 provided on the upper surface of the apparatus main body 101, and an automatic document feeder (ADF) 103 provided on the scanner 102.

A paper feed section 104 including a plurality of paper feed cassettes 104*a*, 104*b*, 104*c* and 104*d* is provided at a lower part of the apparatus main body 101.

An intermediate transfer belt 105, an endless belt, serving as an intermediate transfer member is placed at the approximate center of the apparatus main body 101. The intermediate transfer belt 105 is supported by a plurality of supporting rollers 106, 107 and 108, etc. and rotationally driven in a clockwise direction in FIG. 3 by a drive source (not shown).

In the vicinity of the supporting roller 108, there is provided an intermediate transfer member cleaning device 109 to remove residual toner remaining on the intermediate transfer belt 105 after secondary transfer.

Over the intermediate transfer belt 105 lying between the supporting rollers 106 and 107, four process cartridges 12Y, 12M, 12C and 12K as image forming units for yellow (Y), magenta (M), cyan (C) and black (K) respectively are laterally disposed along its conveyance direction, constituting a tandem image forming section 10. Note that the above-mentioned order in which the process cartridges for the four colors are disposed is given as an example, and they may be disposed in a different order.

An exposing device 8 is placed above the tandem image forming section 10. A secondary transfer roller 110 as a transfer device is placed on the opposite side to the supporting roller 108 with respect to the intermediate transfer belt 105. An image on the intermediate transfer belt 105 is transferred by the secondary transfer roller 110 onto a sheet (paper) fed from the paper feed section 104.

On the left side of the secondary transfer roller 110, there is provided a fixing device 111 to fix the transferred image on the sheet. The fixing device 111 includes a fixing belt 111*a* in the form of an endless belt, and a pressurizing roller 111*b* pressed against the fixing belt 111*a*.

Below the fixing device 111, a sheet reversing device 112 for reversing the sheet when images are recorded on both surfaces of the sheet is placed substantially parallel to the above-mentioned tandem image forming section 10.

Here, a series of processes for image formation, employed as negative-positive processes, is explained.

The photoconductor drum 1 typified by a photoconductor with an organic photoconductive layer (OPC) is subjected to charge elimination by a charge-eliminating lamp (not shown) or the like, then the photoconductor drum 1 is negatively charged in a uniform manner by the charging roller 3 (shown in FIG. 2) as a charging device.

When the photoconductor drum 1 is charged by the charging roller 3, a voltage of appropriate intensity or a charged voltage made by superimposing an AC voltage onto the voltage, which is suitable for charging the photoconductor drum 1 to a desired electric potential, is applied from a voltage applying device (not shown) to the charging roller 3.

On the charged photoconductor drum 1, a latent image is formed utilizing a laser beam applied by the exposing device 8 based upon a laser optical system or the like (the absolute value of the electric potential of the exposed portion is smaller than that of the electric potential of the unexposed portion).

The laser beam is emitted from a semiconductor laser, and the surface of the photoconductor drum 1 is scanned in the direction of the rotational shaft of the photoconductor drum 1, using a multifaceted mirror of a polygonal column (polygon) or the like which rotates at high speed.

The latent image thus formed is developed with a developer which is made of toner particles or a mixture of toner particles and carrier particles, supplied onto the developing roller 51 of the developing device 5, and a visible toner image is thereby formed.

When the latent image is developed, a voltage of appropriate intensity or a developing bias made by superimposing an AC voltage onto the voltage is applied from the voltage applying mechanism (not shown) to a development sleeve, with the intensity being between the intensities of the voltages for the exposed portion and the unexposed portion of the photoconductor drum 1.

Toner images formed on photoconductor drums 1Y, 1M, 1C and 1K for yellow, magenta, cyan and black respectively are transferred onto the intermediate transfer belt 105 in a superimposed manner by transfer rollers 6Y, 6M, 6C and 6K, and the superimposed toner image (color image) is transferred at one time by the secondary transfer roller 110 onto a transfer medium (sheet) such as paper fed from the paper feed section 104 or from a manual bypass tray 113.

An electric potential having the opposite polarity to the polarity of the toner charging is preferably applied to each of the transfer rollers 6Y, 6M, 6C and 6K as a transfer bias.

Toner particles remaining on each photoconductor drum 1 are swept into a toner recovery chamber inside the cleaning device 4 by the cleaning blade 41 and thusly recovered.

The sheet onto which the image has been transferred is conveyed to the fixing device 111 where the image is fixed on the sheet by application of heat and pressure, then the sheet is ejected by a pair of paper ejecting rollers 115 and laid on a paper output tray 116.

Alternatively, with its conveyance path switched by a switching claw (not shown), the sheet is carried into the sheet reversing device 112 where the sheet is reversed, then the sheet is again led to the transfer position so that an image is recorded on the back surface of the sheet as well, and finally the sheet is ejected by the pair of paper ejecting rollers 115 and laid on the paper output tray 116.

Residual toner remaining on the intermediate transfer belt 105 after the image has been transferred onto the sheet is removed by the intermediate transfer member cleaning device 109, and a preparation for the next image formation by the tandem image forming section 10 is thus made.

The image forming apparatus is not necessarily an apparatus employing a tandem-type intermediate transfer method in which, as described above, a plurality of developing devices are provided, a plurality of toner images of different colors that have been sequentially produced by the developing devices are sequentially transferred onto an intermediate transfer medium, and subsequently these toner images are transferred onto a transfer medium such as paper at one time and then fixed thereto; the image forming apparatus may, for example, be an apparatus employing a tandem-type direct transfer method in which a plurality of toner images similarly produced are sequentially transferred to a transfer medium so as to be superimposed on top of one another, and then fixed to the transfer medium.

The charging device is preferably a charging device placed in contact with or close to the surface of the image bearing member. This makes it possible to greatly reduce the amount of ozone generated at the time of charging in comparison with corona dischargers using discharge wires, which are so-called corotron dischargers and scorotron dischargers.

It should, however, be noted that in a charging device which performs charging with a charging member placed in contact with or close to the surface of an image bearing member, since electric discharge is performed in the vicinity of the surface of the image bearing member as described above, there tends to be great electrical stress on the image bearing member. Use of a protective layer forming device utilizing the image-bearing member protecting agent of the present invention makes it possible to sustain the quality of an image bearing member over a long period of time without causing degradation of the image bearing member; hence, it is possible to greatly reduce temporal variation in the quality of images and variation in the quality of images caused by a use environment and thus to secure stable image quality.

EXAMPLES

The following explains Examples of the present invention; however, it should be noted that the present invention is not confined to these Examples in any way.

Table 1 shows Examples concerning formulations (mixing conditions) of image-bearing member protecting agents according to the present embodiment. In the image producing section of the color copier IMAGIO MP C4500 (manufactured by Ricoh Company, Ltd.) (shown in FIG. 2), each of the image-bearing member protecting agents according to the Examples was supplied from the protective layer forming device 2.

A test was carried out in which images were continuously formed on 10,000 sheets of A4 size paper with an image area ratio of 5%, and evaluations were made regarding smearing of a charging member (charging roller 3), toner leakage and photoconductor protecting capability.

Tables 2 and 3 show mixing conditions of Comparative Examples, and Tables 4 and 5 show evaluation results concerning Examples and Comparative Examples.

Note that "Ex" in Tables 1 and 4 denotes "Example", and "Comp Ex" in Tables 2, 3 and 5 denotes "Comparative Example".

TABLE 1

| Name of material (Manufacturer) | Crystal diameter (μm) | Secondary particle diameter (μm) | Ex 1 | Ex 2 | Ex 3 | Ex 4 | Ex 5 |
|---|---|---|---|---|---|---|---|
| Zinc stearate (Wako Pure Chemical Industries, Ltd.) | — | | | | 80% | 80% | 80% |
| Calcium stearate (Wako Pure Chemical Industries, Ltd.) | — | | 80% | | | | |
| Zinc laurate (Wako Pure Chemical Industries, Ltd.) | — | | | 80% | | | |
| Boron nitride (NanoGram Corporation) | 0.07 | 0.07 | | | | | |
| Boron nitride (NX1, Momentive Performance Materials Inc.) | 0.2 | 0.7 | | | | | |
| Boron nitride (NX5, Momentive Performance Materials Inc.) | 0.3 | 5 | 20% | 20% | 20% | | |
| Boron nitride (NX10, Momentive Performance Materials Inc.) | 0.3 | 10 | | | | 20% | |
| Boron nitride (SP-2, DENKI KAGAKU KOGYO KABUSHIKI KAISHA) | 0.7 | 4.8 | | | | | 20% |
| Boron nitride (S1-F, ESK Ceramics GmbH & Co. KG) | 0.5 | 2 | | | | | |
| Boron nitride (HP-P1, MIZUSHIMA FERROALLOY CO., LTD.) | 2 | 2 | | | | | |
| Boron nitride (HGP, DENKI KAGAKU KOGYO KABUSHIKI KAISHA) | 5 | 5 | | | | | |
| Boron nitride (MGP, DENKI KAGAKU KOGYO KABUSHIKI KAISHA) | 13 | 13 | | | | | |
| Boron nitride (S-15, ESK Ceramics GmbH & Co. KG) | 15 | 15 | | | | | |
| Boron nitride (SGP, DENKI KAGAKU KOGYO KABUSHIKI KAISHA) | 17.7 | 17.7 | | | | | |

TABLE 2

| Name of material (Manufacturer) | Crystal diameter (μm) | Secondary particle diameter (μm) | Comp Ex 1 | Comp Ex 2 | Comp Ex 3 | Comp Ex 4 | Comp Ex 5 | Comp Ex 6 |
|---|---|---|---|---|---|---|---|---|
| Zinc stearate (Wako Pure Chemical Industries, Ltd.) | — | | 100% | 90% | 90% | 80% | 80% | 80% |
| Calcium stearate (Wako Pure Chemical Industries, Ltd.) | — | | | 10% | | | | |

TABLE 2-continued

| Name of material (Manufacturer) | Crystal diameter (μm) | Secondary particle diameter (μm) | Comp Ex 1 | Comp Ex 2 | Comp Ex 3 | Comp Ex 4 | Comp Ex 5 | Comp Ex 6 |
|---|---|---|---|---|---|---|---|---|
| Zinc laurate (Wako Pure Chemical Industries, Ltd.) | — | | | | 10% | | | |
| Boron nitride (NanoGram Corporation) | 0.07 | 0.07 | | | | 20% | | |
| Boron nitride (NX1, Momentive Performance Materials Inc.) | 0.2 | 0.7 | | | | | 20% | |
| Boron nitride (NX5, Momentive Performance Materials Inc.) | 0.3 | 5 | | | | | | |
| Boron nitride (NX10, Momentive Performance Materials Inc.) | 0.3 | 10 | | | | | | |
| Boron nitride (SP-2, DENKI KAGAKU KOGYO KABUSHIKI KAISHA) | 0.7 | 4.8 | | | | | | |
| Boron nitride (S1-F, ESK Ceramics GmbH & Co. KG) | 0.5 | 2 | | | | | | 20% |
| Boron nitride (HP-P1, MIZUSHIMA FERROALLOY CO., LTD.) | 2 | 2 | | | | | | |
| Boron nitride (HGP, DENKI KAGAKU KOGYO KABUSHIKI KAISHA) | 5 | 5 | | | | | | |
| Boron nitride (MGP, DENKI KAGAKU KOGYO KABUSHIKI KAISHA) | 13 | 13 | | | | | | |
| Boron nitride (S-15, ESK Ceramics GmbH & Co. KG) | 15 | 15 | | | | | | |
| Boron nitride (SGP, DENKI KAGAKU KOGYO KABUSHIKI KAISHA) | 17.7 | 17.7 | | | | | | |

TABLE 3

| Name of material (Manufacturer) | Crystal diameter (μm) | Secondary particle diameter (μm) | Comp Ex 7 | Comp Ex 8 | Comp Ex 9 | Comp Ex 10 | Comp Ex 11 |
|---|---|---|---|---|---|---|---|
| Zinc stearate (Wako Pure Chemical Industries, Ltd.) | — | | 80% | 80% | 80% | 80% | 80% |
| Calcium stearate (Wako Pure Chemical Industries, Ltd.) | — | | | | | | |
| Zinc laurate (Wako Pure Chemical Industries, Ltd.) | — | | | | | | |
| Boron nitride (NanoGram Corporation) | 0.07 | 0.07 | | | | | |
| Boron nitride (NX1, Momentive Performance Materials Inc.) | 0.2 | 0.7 | | | | | |
| Boron nitride (NX5, Momentive Performance Materials Inc.) | 0.3 | 5 | | | | | |

TABLE 3-continued

| Name of material (Manufacturer) | Crystal diameter (μm) | Secondary particle diameter (μm) | Comp Ex 7 | Comp Ex 8 | Comp Ex 9 | Comp Ex 10 | Comp Ex 11 |
|---|---|---|---|---|---|---|---|
| Boron nitride (NX10, Momentive Performance Materials Inc.) | 0.3 | 10 | | | | | |
| Boron nitride (SP-2, DENKI KAGAKU KOGYO KABUSHIKI KAISHA) | 0.7 | 4.8 | | | | | |
| Boron nitride (S1-F, ESK Ceramics GmbH & Co. KG) | 0.5 | 2 | | | | | |
| Boron nitride (HP-P1, MIZUSHIMA FERROALLOY CO., LTD.) | 2 | 2 | 20% | | | | |
| Boron nitride (HGP, DENKI KAGAKU KOGYO KABUSHIKI KAISHA) | 5 | 5 | | 20% | | | |
| Boron nitride (MGP, DENKI KAGAKU KOGYO KABUSHIKI KAISHA) | 13 | 13 | | | 20% | | |
| Boron nitride (S-15, ESK Ceramics GmbH & Co. KG) | 15 | 15 | | | | 20% | |
| Boron nitride (SGP, DENKI KAGAKU KOGYO KABUSHIKI KAISHA) | 17.7 | 17.7 | | | | | 20% |

TABLE 4

| | Cleanability | Smearing of charging member | Photoconductor protecting capability |
|---|---|---|---|
| Ex 1 | B | B | B |
| Ex 2 | B | A | B |
| Ex 3 | A | A | A |
| Ex 4 | A | A | A |
| Ex 5 | A | A | A |

Regarding "cleanability" in Tables 4 and 5, A means that there is almost no leakage of toner, B means that toner sometimes leaks but abnormal images do not arise, C means that toner often leaks and abnormal images arise in some cases, and D means that abnormal images frequently arise.

Regarding "smearing of charging member" in Tables 4 and 5, A means that the charging member is almost never smeared, B means that the charging member is somewhat smeared but it does not affect images at normal temperature, C means that the charging member is smeared to such an extent that images are affected at low temperatures, and D means that abnormal images arise at an early stage.

Regarding "photoconductor protecting capability" in Tables 4 and 5, A means that there is almost no abrasion of the photoconductor and almost no filming, B means that there is slight filming but it is acceptable, C means that abnormal images arise with time, and D means that abnormal images arise at an early stage.

TABLE 5

| | Cleanability | Smearing of charging member | Photoconductor protecting capability |
|---|---|---|---|
| Comp Ex 1 | C | D | A |

TABLE 5-continued

| | Cleanability | Smearing of charging member | Photoconductor protecting capability |
|---|---|---|---|
| Comp Ex 2 | D | C | B |
| Comp Ex 3 | D | C | B |
| Comp Ex 4 | C | C | B |
| Comp Ex 5 | B | B | C |
| Comp Ex 6 | A | A | D |
| Comp Ex 7 | A | A | C |
| Comp Ex 8 | A | A | C |
| Comp Ex 9 | A | A | C |
| Comp Ex 10 | A | A | D |
| Comp Ex 11 | A | A | D |

Explanation of Examples

Examples 1 and 2

Boron nitride having a crystal diameter of 0.1 μm to 1.0 μm and a secondary particle diameter of 3.0 μm to 14.0 μm and a fatty acid metal salt were mixed together to constitute an image-bearing member protecting agent.

Examples 3 to 5

Boron nitride having a crystal diameter of 0.1 μm to 1.0 μm and a secondary particle diameter of 3.0 μm to 14.0 μm and a fatty acid metal salt were mixed together to constitute an image-bearing member protecting agent, in which the fatty acid metal salt was zinc stearate.

Explanation of Comparative Examples

Comparative Example 1

Only one kind of fatty acid metal salt was used to constitute an image-bearing member protecting agent.

Comparative Examples 2 and 3

Two different kinds of fatty acid metal salts were mixed together to constitute an image-bearing member protecting agent.

Comparative Example 4

Boron nitride having a crystal diameter of less than 0.1 μm and a fatty acid metal salt were mixed together to constitute an image-bearing member protecting agent.

Comparative Examples 5 and 6

Boron nitride having a crystal diameter of 0.1 μm to 1.0 μm and a secondary particle diameter of less than 3.0 μm and a fatty acid metal salt were mixed together to constitute an image-bearing member protecting agent.

Comparative Example 7

Boron nitride having a crystal diameter of greater than 1.0 μm, which did not include secondary particles or which had a secondary particle diameter of less than 3.0 μm, and a fatty acid metal salt were mixed together to constitute an image-bearing member protecting agent.

Comparative Examples 8 and 9

Boron nitride having a crystal diameter of greater than 1.0 μm, which did not include secondary particles or which had a secondary particle diameter of 3.0 μm to 14.0 μm, and a fatty acid metal salt were mixed together to constitute an image-bearing member protecting agent.

Comparative Examples 10 and 11

Boron nitride having a crystal diameter of greater than 1.0 μm, which did not include secondary particles or which had a secondary particle diameter of greater than 14.0 μm, and a fatty acid metal salt were mixed together to constitute an image-bearing member protecting agent.

[Consideration of Results Shown by Tables]

It is inferred that an image-bearing member protecting agent of the present invention makes it possible to prevent toner leakage, smearing of a charging member and filming on an image bearing member for the following reasons.

An image-bearing member protecting agent is applied to an electrophotographic image bearing member in order to protect the image bearing member from hazards at the times of charging and cleaning. However, a fatty acid metal salt generally used for the image-bearing member protecting agent decreases in lubricating property as affected by charging, and thus toner leaks through a gap between a cleaning member and the surface of the image bearing member, causing cleaning failure. Moreover, the fatty acid metal salt itself flies and adheres to a charging member, thus smearing the charging member.

It should be noted that addition of boron nitride makes it possible to improve lubricating property and prevent toner leakage. Further, the improvement in lubricating property makes it possible to reduce the amount of the fatty acid metal salt leaking and thus to reduce the amount of the fatty acid metal salt flying to the charging member.

Use of only one kind of fatty acid metal salt as in Comparative Example 1 causes cleaning failure and smearing of the charging member.

Use of a plurality of kinds of fatty acid metal salts as in Comparative Examples 2 and 3 causes cleanability to decrease in comparison with the case where one kind of fatty acid metal salt is used.

In the case where boron nitride having a crystal diameter of less than 0.1 μm and a fatty acid metal salt are mixed together as in Comparative Example 4, almost no image-bearing member protecting effect is obtained. It is inferred that this is because cleavage surfaces of the boron nitride are too small to be parallel to each other, thus not exhibiting lubricating properties.

In the case where boron nitride having a crystal diameter of 0.1 μm to 1.0 μm (which is larger than that in Comparative Example 4) but having a secondary particle diameter of less than 3.0 μm and a fatty acid metal salt are mixed together as in Comparative Example 5 or 6, the photoconductor is smeared.

In the case where boron nitride having a crystal diameter of greater than 1.0 μm, which does not include secondary particles or which has a secondary particle diameter of less than 3.0 μm, and a fatty acid metal salt are mixed together to constitute an image-bearing member protecting agent as in Comparative Example 7, the photoconductor is less smeared but a great image-bearing member protecting effect cannot be obtained.

In the case where boron nitride having a crystal diameter of greater than 1.0 μm, which does not include secondary particles or which has a secondary particle diameter of 3.0 μm to 14.0 μm, and a fatty acid metal salt are mixed together to constitute an image-bearing member protecting agent as in Comparative Example 8 or 9, the photoconductor is smeared.

In the case where boron nitride having a crystal diameter of greater than 1.0 μm, which does not include secondary particles or which has a secondary particle diameter of greater than 14.0 μm, and a fatty acid metal salt are mixed together to constitute an image-bearing member protecting agent as in Comparative Example 10 or 11, the photoconductor is further smeared. It is inferred that this is because cleavage surfaces of the boron nitride are so large as to exhibit excessively high lubricating properties, and thus much of the boron nitride is laid over the photoconductor without being removed by a cleaning member.

Meanwhile, in the case where boron nitride having a crystal diameter of 0.1 μm to 1.0 μm and a secondary particle diameter of 3.0 μm to 14.0 μm and a fatty acid metal salt are mixed together to constitute an image-bearing member protecting agent as in Examples, the photoconductor is less smeared.

It is inferred that this is because the boron nitride's crystal diameter which is not very large prevents the boron nitride from easily being laid over the photoconductor, and the fact that the boron nitride includes somewhat large secondary particles allows the boron nitride to be easily removed by a cleaning member.

The crystal diameter of boron nitride in the present invention means the average primary particle diameter of boron nitride crystals. The boron nitride crystals are measured for their primary particle diameters using IMAGE-PRO PLUS 4.0J based upon an image observed using an SEM (THERMAL FE-SEM (ZEISS ULTRA55)), and the average of the primary particle diameters is defined as the crystal diameter.

The secondary particle diameter of the boron nitride in the present invention means the average diameter of secondary particles composed of aggregated boron nitride crystals. The secondary particles of the boron nitride are measured for their diameters using the laser diffraction particle size distribution measuring apparatus SALD-2200 (manufactured by Shimadzu Corporation), and the D50 value thereof is defined as the secondary particle diameter.

A comparison between Examples 1 and 2 and Example 3 reveals that zinc stearate is superior to the other fatty acid metal salts in cleanability and photoconductor protecting capability.

Furthermore, stearic acid is one of the most inexpensive higher fatty acids; in particular, zinc salt of stearic acid is a very stable substance superior in hydrophobicity.

Since the image-bearing member protecting agent of the present invention exhibits protecting effects by adhering to the surface of the image bearing member and forming into a film thereon, the agent undergoes plastic deformation relatively easily. Therefore, in the case where a protective layer is formed by directly pressing a mass of components of an image-bearing member protecting agent against the surface of the image bearing member, the agent is excessively supplied, which not only decreases efficiency in forming the protective layer but also often disturbs transmission of light in an exposing step (for forming a latent electrostatic image, for example) as the protective layer has a multilayer structure; thus, in this case, limited kinds of image-bearing member protecting agents can only be used.

As opposed to the foregoing case, by constituting a protective layer forming device as described above and providing a supply member between an image-bearing member protecting agent and an image bearing member, it is possible to supply the agent evenly onto the surface of the image bearing member even when the agent is soft.

Additionally, if a protective layer forming member which presses the image-bearing member protecting agent and forms it into a film is provided in the protective layer forming device, the protective layer forming mechanism may function also as a cleaning member; however, in order to form a protective layer more surely, it is preferable to remove residual matter, composed mainly of toner, on the image bearing member by a cleaning member beforehand and thus prevent the residual matter from being mixed into the protective layer.

By constituting an image forming apparatus using the protective layer forming device which includes the image-bearing member protecting agent, it is possible to continue using the image bearing member over a very long period of time without the need to replace it.

Especially when at least a layer formed as the outermost surface of the image bearing member contains a thermosetting resin, prevention of degradation of the image bearing member, caused by electrical stress, with the image-bearing member protecting agent makes it possible to sustain durability of the image bearing member, which includes the thermosetting resin, over a long period of time against mechanical stress. Thus, it is possible to increase the durability of the image bearing member to such a level that the image bearing member can be used, virtually without the need to replace it.

As for a charging device placed in contact with or close to the surface of the image bearing member, since a discharge area lies very close to the image bearing member, electrical stress on the image bearing member tends to be great. However, the image forming apparatus of the present invention with a protective layer on the image bearing member can be used without the image bearing member being exposed to much electrical stress.

Also, since change in the state of the surface of the image bearing member can be minimized due to the effects of the protective layer formed thereon, it is possible to perform stable cleaning over a long period of time even in the case of using toner of great circularity or toner having a small average particle diameter, in which the quality of cleaning greatly varies depending upon change in the state of the surface of the image bearing member.

By constituting a process cartridge using the protective layer forming device which includes the image-bearing member protecting agent, it is possible to greatly lengthen the period of time for which the process cartridge can be used without being replaced, and thus it is possible to lower the running cost and greatly reduce the amount of waste.

Especially when at least a layer formed as the outermost surface of the image bearing member contains a thermosetting resin, prevention of degradation of the image bearing member, caused by electrical stress, with the image-bearing member protecting agent makes it possible to sustain durability of the image bearing member, which includes the thermosetting resin, over a long period of time against mechanical stress.

Next, a photoconductor able to be suitably used in the present invention will be explained.

A photoconductor used in the image forming apparatus of the present invention includes a conductive support, and a photosensitive layer provided on the conductive support. The structure of the photosensitive layer is selected from a single-layer structure in which a charge generating material and a charge transporting material are present in a mixed manner, a regular layer structure in which a charge transporting layer is provided on a charge generating layer, and an opposite layer structure in which a charge generating layer is provided on a charge transporting layer. Additionally, a surface layer may be provided on the photosensitive layer in order to improve the mechanical strength, abrasion resistance, gas resistance, cleanability, etc. of the photoconductor. Further, an underlying layer may be provided between the photosensitive layer and the conductive support. Also, if necessary, an appropriate amount of a plasticizer, an antioxidant, a leveling agent, etc. may be added to each layer.

As the conductive support of the photoconductor, what can be used is a material exhibiting conductivity of $10^{10}$ Ω·cm or less in volume resistance. Examples thereof include a construction formed by coating a film-like or cylindrical piece of plastic or paper with a metal such as aluminum, nickel, chrome, Nichrome, copper, gold, silver or platinum or with a metal oxide such as tin oxide or indium oxide by means of vapor deposition or sputtering; a plate of aluminum, aluminum alloy, nickel, stainless, etc.; and a tube produced by forming the plate into a drum-shaped mother tube by means of drawing, extrusion, etc. and then surface-treating the mother tube by means of cutting, superfinishing, polishing, etc.

A drum-shaped support preferably has a diameter of 20 mm to 150 mm, preferably 24 mm to 100 mm, more preferably 28 mm to 70 mm. If the drum-shaped support has a diameter of 20 mm or less, it is physically difficult to place, around the drum, members for the steps of charging, exposing, developing, transferring and cleaning. If the drum-shaped support has a diameter of 150 mm or greater, it is undesirable because the image forming apparatus is enlarged.

Particularly in the case where the image forming apparatus is of tandem type, it is necessary to install a plurality of photoconductors therein, so that the diameter of the support of each photoconductor is preferably 70 mm or less, more preferably 60 mm or less. Parenthetically, the endless nickel belt and the endless stainless steel belt disclosed in JP-A No. 52-36016 can be used as conductive supports.

Examples of the underlying layer of the photoconductor used in the image forming apparatus of the present invention include a layer composed mainly of resin, a layer composed mainly of white pigment and resin, and an oxidized metal film obtained by chemically or electrically oxidizing the surface of a conductive substrate; preference is given to the layer composed mainly of white pigment and resin. Examples of the white pigment include metal oxides such as titanium oxide, aluminum oxide, zirconium oxide and zinc oxide; among these, it is most desirable to use titanium oxide that is superior in preventing penetration of electric charge from the conductive substrate.

Examples of the resin used for the underlying layer include thermoplastic resins such as polyamide, polyvinyl alcohol, casein and methyl cellulose, and thermosetting resins such as acrylics, phenol resins, melamine resins, alkyds, unsaturated polyesters and epoxies. These may be used individually or in combination.

Examples of the charge generating material of the photoconductor used in the image forming apparatus of the present invention include azo pigments such as monoazo pigments, bisazo pigments, trisazo pigments and tetrakisazo pigments; organic pigments and dyes such as triarylmethane dyes, thiazine dyes, oxazine dyes, xanthene dyes, cyanine pigments, styryl pigments, pyrylium dyes, quinacridone pigments, indigo pigments, perylene pigments, polycyclic quinone pigments, bisbenzimidazole pigments, indanthrone pigments, squarylium pigments and phthalocyanine pigments; and inorganic materials such as selenium, selenium-arsenic, selenium-tellurium, cadmium sulfide, zinc oxide, titanium oxide and amorphous silicon. These may be used individually or in combination. The underlying layer may have a single-layer structure or a multilayer structure.

Examples of the charge transporting material of the photoconductor used in the image forming apparatus of the present invention include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives and triphenylmethane derivatives. These may be used individually or in combination.

Binder resin(s) used in forming the photosensitive layer composed of the charge generating layer and the charge transporting layer is/are electrically insulative and may be selected from known thermoplastic resins, thermosetting resins, photocurable resins, photoconductive resins and the like. Suitable examples thereof include, but are not limited to, thermoplastic resins such as polyvinyl chloride, polyvinylidene chloride, vinyl chloride-vinyl acetate copolymers, vinyl chloride-vinyl acetate-maleic anhydride copolymers, ethylene-vinyl acetate copolymers, polyvinyl butyral, polyvinyl acetal, polyesters, phenoxy resins, (meth)acrylic resins, polystyrene, polycarbonates, polyarylate, polysulphone, polyethersulphone and ABS resins; thermosetting resins such as phenol resins, epoxy resins, urethane resins, melamine resins, isocyanate resins, alkyd resins, silicone resins and thermosetting acrylic resins; and photoconductive resins such as polyvinylcarbazole, polyvinylanthracene and polyvinylpyrene. These may be used individually or in combination.

Examples of the antioxidant include the following compounds.

[Monophenolic Compounds]

2,6-di-t-butyl-p-cresol, butylated hydroxyanisole, 2,6-di-t-butyl-4-ethylphenol, stearyl-β-(3,5-di-t-butyl-4-hydroxyphenyl)propionate, 3-t-butyl-4-hydroxyanisole and so forth

[Bisphenolic Compounds]

2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol) and so forth

[Polymeric Phenolic Compounds]

1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, tocophenols and so forth

[p-Phenylenediamines]

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine and so forth

[Hydroquinones]

2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and so forth

[Organic Sulfur Compounds]

dilauryl-3,3'-thiodipropionate, distearyl-3,3'-thiodipropionate, ditetradecyl-3,3'-thiodipropionate and so forth

[Organic Phosphorus Compounds]

triphenylphosphine, tri(nonylphenyl)phosphine, tri(dinonylphenyl)phosphine, tricresylphosphine, tri(2,4-dibutylphenoxy)phosphine and so forth For the plasticizer, a resin such as dibutyl phthalate or dioctyl phthalate generally used as a plasticizer can be used without the need to change it in any way. It is appropriate that the amount of the plasticizer used be 0 parts by mass to 30 parts by mass per 100 parts by mass of the binder resin.

A leveling agent may be added into the charge transporting layer. Examples of the leveling agent include silicone oils such as dimethyl silicone oil and methylphenyl silicone oil; and polymers or oligomers having perfluoroalkyl groups in their side chains. It is appropriate that the amount of the leveling agent used be 0 parts by mass to 1 part by mass per 100 parts by mass of the binder resin.

As described above, the surface layer is provided in order to improve the mechanical strength, abrasion resistance, gas resistance, cleanability, etc. of the photoconductor. Examples of the material for the surface layer include a polymer, and a polymer with an inorganic filler dispersed therein, both of which have greater mechanical strength than the photosensitive layer. The polymer used for the surface layer may be a thermoplastic polymer or a thermosetting polymer, with preference being given to a thermosetting polymer because it has high mechanical strength and is highly capable of reducing abrasion caused by friction with a cleaning blade.

As long as the surface layer is thin, there may be no problem if it does not have charge transporting capability; however, when a surface layer not having charge transporting capability is formed so as to be thick, the photoconductor is easily caused to decrease in sensitivity, increase in electric potential after exposure, and increase in residual potential, so that it is desirable to mix the above-mentioned charge transporting material into the surface layer or use a polymer with charge transporting capability for the surface layer. Generally, the photosensitive layer and the surface layer greatly differ from each other in mechanical strength, so that once the surface layer is abraded owing to friction with the cleaning blade and thusly disappears, the photosensitive layer is also abraded; therefore, when the surface layer is provided, it is important to make it have a sufficient thickness, the thickness being 0.01 μm to 12 μm, preferably 1 μm to 10 μm, more preferably 2 μm to 8 μm. If the thickness of the surface layer is less than 0.01 μm, it is not desirable because the surface layer is so thin that parts of the surface layer easily disappear owing to friction with the cleaning blade, and abrasion of the photosensitive layer progresses through the missing parts. If the thickness of the surface layer is greater than 12 μm, it is not desirable either because the photoconductor is easily caused to decrease in sensitivity, increase in electric potential after exposure, and increase in residual potential and, especially when a polymer with charge transporting capability is used, the cost of the polymer increases.

As the polymer used for the surface layer, a polymer which is transparent to writing light at the time of image formation and superior in insulation, mechanical strength and adhesiveness is desirable, and examples thereof include resins such as ABS resins, ACS resins, olefin-vinyl monomer copolymers, chlorinated polyethers, allyl resins, phenol resins, polyacetals, polyamides, polyamide-imides, polyacrylates, polyallylsulfones, polybutylene, polybutylene terephthalate, polycarbonates, polyethersulfones, polyethylene, polyethylene terephthalate, polyimides, acrylic resins, polymethylpentene, polypropylene, polyphenylene oxide, polysulfones, polystyrene, AS resins, butadiene-styrene copolymers, polyurethanes, polyvinyl chloride, polyvinylidene chloride and epoxy resins. The polymer exemplified by these may be a thermoplastic polymer; however, when a thermosetting polymer produced by cross-linkage with a multifunctional cross-linking agent having an acryloyl group, carboxyl group, hydroxyl group, amino group, etc. is used as the polymer to enhance its mechanical strength, the surface layer increases in mechanical strength and it becomes possible to greatly reduce abrasion of the surface layer caused by friction with the cleaning blade.

As described above, the surface layer preferably has charge transporting capability. In order for the surface layer to have charge transporting capability, it is possible to employ a method in which a polymer used for the surface layer and the above-mentioned charge transporting material are mixed together, or a method in which a polymer having charge transporting capability is used as the surface layer, with the latter method being preferable because a photoconductor which is highly sensitive and does not increase much in electric potential after exposure or in residual potential can be obtained.

The image bearing member in the present invention may be an intermediate transfer medium used in image formation by a so-called intermediate transfer method in which color toner images formed on photoconductor(s) are primarily transferred so as to be superimposed on top of one another, and then transferred onto a transfer medium.

The intermediate transfer medium preferably exhibits conductivity of $10^5$ Ω·cm to $10^{11}$ Ω·cm in volume resistance. If the volume resistance is lower than $10^5$ Ω·cm, a phenomenon of so-called transfer dust may arise in which toner images become unstable owing to electric discharge, when the toner images are transferred from the photoconductors onto the intermediate transfer medium. If the volume resistance is higher than $10^{11}$ Ω·cm, opposing electric charge of a toner image may remain on the intermediate transfer medium and thus an afterimage may appear on the next image, after the toner image has been transferred from the intermediate transfer medium onto a transfer medium such as paper.

For the intermediate transfer medium, a belt-like or cylindrical plastic may, for example, be used which is produced by kneading a thermoplastic resin together with any one or combination of a metal oxide such as tin oxide or indium oxide, a conductive polymer and a conductive particle such as carbon black and then subjecting the mixture to extrusion molding. Besides, it is possible to obtain an intermediate transfer medium in the form of an endless belt by heating and centrifugally molding a resin solution containing a thermally crosslinkable monomer or oligomer, with the addition of the above-mentioned conductive particle and/or conductive polymer, if necessary.

When the intermediate transfer medium is provided with a surface layer, the materials for the surface layer of the photoconductor, excluding the charge transporting material, may be used for the surface layer after suitably subjected to resistance adjustment with the use of a conductive material.

Next, a toner able to be suitably used in the present invention will be explained.

Firstly, a toner in the present invention preferably has an average circularity of 0.93 to 1.00. In the present invention, the value obtained from Equation (1) is defined as the circularity. The circularity indicates the degree of unevenness of a toner particle; when the toner particle is perfectly spherical, the circularity is 1.00; meanwhile, the more complex the surface shape of the toner particle becomes, the smaller the circularity becomes.

Circularity $SR$=Circumferential length of circle having the same area as projected particle area/Circumferential length of projected particle image (Equation 1)

When the average circularity is in the range of 0.93 to 1.00, the surface of toner particles is smooth, and the area where the toner particles are in contact with one another and the area where the toner particles are in contact with the photoconductor are small, so that superior transferability can be obtained.

The toner particles do not have angles, so that the torque with which a developer is agitated in a developing device can be reduced and the driving for agitation can be stabilized; therefore, abnormal images do not arise.

Since the toner particles which form dots do not include angular toner particles, pressure is uniformly applied to the entire toner particles when they are transferred and pressed against a transfer medium, and thus absence of toner particles hardly arises during the transfer.

Since the toner particles are not angular, the toner particles themselves have little abrasive power, thus not damaging or abrading the surface of the image bearing member.

Next, a method of measuring the circularity will be explained.

The circularity can be measured using the flow-type particle image analyzer FPIA-1000 (manufactured by Toa Medical Electronics Co., Ltd.).

Specifically, 0.1 mL to 0.5 mL of a surfactant (preferably alkylbenzene sulfonate) is added as a dispersant into 100 mL to 150 mL of water in a container, from which solid impurities have previously been removed. Then approximately 0.1 g to 0.5 g of a measurement sample (toner) is added. The suspension in which the sample is dispersed is subjected to dispersing treatment by an ultrasonic dispersing device for approximately 1 min to 3 min, and the concentration of the dispersed solution is adjusted such that the number of particles of the sample is 3,000 per microliter to 10,000 per microliter. Under this condition, the particle shape and particle size of the toner are measured using the analyzer.

In the present invention, a weight average particle diameter $D_4$ of the toner is preferably in the range of 3 μm to 10 μm.

When the weight average particle diameter $D_4$ is in this range, superior dot reproducibility can be obtained because the toner includes particles which are sufficiently small in diameter with respect to fine dots of a latent image.

When the weight average particle diameter $D_4$ is less than 3 μm, a phenomenon easily arises in which there is a decrease in transfer efficiency and blade cleaning capability.

When the weight average particle diameter $D_4$ is greater than 10 μm, it is difficult to reduce raggedness of lines and letters/characters.

The ratio ($D_4/D_1$) of the weight average particle diameter $D_4$ of the toner to a number average particle diameter $D_1$ of the toner is in the range of 1.00 to 1.40. The closer the value of the ratio ($D_4/D_1$) is to 1, the sharper the particle size distribution of the toner is.

Thus, when the ratio ($D_4/D_1$) is in the range of 1.00 to 1.40, differences in particle diameter of the toner do not cause particles to be unevenly used for image formation, so that the image quality can be excellently stabilized.

Since the particle size distribution of the toner is sharp, the distribution of the frictional charge amount is also sharp, and thus the occurrence of fogging can be reduced.

When the toner has a uniform particle diameter, a latent image is developed such that particles are accurately and neatly arranged on dots of the latent image, and thus superior dot reproducibility can be obtained.

Next, a method of measuring the particle size distribution of toner particles will be explained.

Examples of a measuring device for measuring the particle size distribution of toner particles in accordance with a Coulter counter method include COULTER COUNTER TA-II and COULTER MULTISIZER II (both of which are manufactured by Coulter Corporation). The following describes the method.

Firstly, 0.1 mL to 5 mL of a surfactant (preferably alkylbenzene sulfonate) is added as a dispersant into 100 mL to 150 mL of an electrolytic aqueous solution. Here, the electrolytic aqueous solution means an approximately 1% NaCl aqueous solution prepared using primary sodium chloride. For the preparation, ISOTON-II (manufactured by Coulter Corporation) can be used, for example. Then 2 mg to 20 mg of a measurement sample (toner) is added. The electrolytic aqueous solution in which the sample is suspended is subjected to dispersing treatment by an ultrasonic dispersing device for approximately 1 min to 3 min, then the volume of the toner or toner particles and the number of the toner particles are measured by the measuring device, using apertures of 100 μm each, and the volume distribution and the number distribution are thus calculated. The weight average particle diameter $D_4$ and the number average particle diameter $D_1$ of the toner can be calculated from these distributions obtained.

As channels, the following 13 channels are used, and particles having diameters which are equal to or greater than 2.00 μm, and less than 40.30 μm are targeted: a channel of 2.00 μm or greater, and less than 2.52 μm; a channel of 2.52 μm or greater, and less than 3.17 μm; a channel of 3.17 μm or greater, and less than 4.00 μm; a channel of 4.00 μm or greater, and less than 5.04 μm; a channel of 5.04 μm or greater, and less than 6.35 μm; a channel of 6.35 μm or greater, and less than 8.00 μm; a channel of 8.00 μm or greater, and less than 10.08 μm; a channel of 10.08 μm or greater, and less than 12.70 μm; a channel of 12.70 μm or greater, and less than 16.00 μm; a channel of 16.00 μm or greater, and less than 20.20 μm; a channel of 20.20 μm or greater, and less than 25.40 μm; a channel of 25.40 μm or greater, and less than 32.00 μm; and a channel of 32.00 μm or greater, and less than 40.30 μm.

For such a substantially spherical toner, it is preferable to use a toner obtained by cross-linking and/or elongating a toner composition including a polyester prepolymer which has a nitrogen atom-containing functional group, a polyester, a colorant and a releasing agent in the presence of fine resin particles in an aqueous medium. The toner produced by the cross-linking and/or elongating reaction makes it possible to reduce hot offset when the toner surface is hardened, and thus to restrain smears from being left on a fixing device and appearing on images.

Examples of prepolymers made of modified polyester resins, which can be used for producing toner, include isocyanate group-containing polyester prepolymers (A). Examples of compounds which elongate and/or cross-link with the prepolymers include amines (B).

Examples of the isocyanate group-containing polyester prepolymers (A) include a compound obtained by reaction between a polyisocyanate (3) and a polyester which is a polycondensate of a polyol (1) and a polycarboxylic acid (2) and contains an active hydrogen group. Examples of the active hydrogen group of the polyester include hydroxyl groups (alcoholic hydroxyl groups and phenolic hydroxyl groups), amino groups, carboxyl group and mercapto group, with preference being given to alcoholic hydroxyl groups.

Examples of the polyol (1) include diols (1-1) and trihydric or higher polyols (1-2), and it is preferable to use any of the diols (1-1) alone, or mixtures each composed of any of the diols (1-1) and a small amount of any of the trihydric or higher polyols (1-2). Examples of the diols (1-1) include alkylene glycols (ethylene glycol, 1,2-propylene glycol, 1,3-propylene glycol, 1,4-butanediol, 1,6-hexanediol, etc.); alkylene ether glycols (diethylene glycol, triethylene glycol, dipropylene glycol, polyethylene glycol, polypropylene glycol, polytetramethylene ether glycol, etc.); alicyclic diols (1,4-cyclohexanedimethanol, hydrogenated bisphenol A, etc.); bisphenols (bisphenol A, bisphenol F, bisphenol S, etc.); alkylene oxide (ethylene oxide, propylene oxide, butylene oxide, etc.) adducts of the alicyclic diols; and alkylene oxide (ethylene oxide, propylene oxide, butylene oxide, etc.) adducts of the bisphenols. Among these, preference is given to alkylene glycols having 2 to 12 carbon atoms, and alkylene oxide adducts of bisphenols, and greater preference is given to alkylene oxide adducts of bisphenols, and combinations of the alkylene oxide adducts and alkylene glycols having 2 to 12 carbon atoms. Examples of the trihydric or higher polyols (1-2) include trihydric to octahydric or higher aliphatic alcohols (glycerin, trimethylolethane, trimethylolpropane, pentaerythritol, sorbitol, etc.); trihydric or higher phenols (trisphenol PA, phenol novolac, cresol novolac, etc.); and alkylene oxide adducts of the trihydric or higher phenols.

Examples of the polycarboxylic acid (2) include dicarboxylic acids (2-1) and trivalent or higher polycarboxylic acids (2-2), and it is preferable to use any of the dicarboxylic acids (2-1) alone, or mixtures each composed of any of the dicarboxylic acids (2-1) and a small amount of any of the trivalent or higher polycarboxylic acids (2-2). Examples of the dicarboxylic acids (2-1) include alkylene dicarboxylic acids (succinic acid, adipic acid, sebacic acid, etc.); alkenylene dicarboxylic acids (maleic acid, fumaric acid, etc.); and aromatic dicarboxylic acids (phthalic acid, isophthalic acid, terephthalic acid, naphthalenedicarboxylic acid, etc.). Among these, preference is given to alkenylene dicarboxylic acids having 4 to 20 carbon atoms and aromatic dicarboxylic acids having 8 to 20 carbon atoms. Examples of the trivalent or higher polycarboxylic acids (2-2) include aromatic polycarboxylic acids (trimellitic acid, pyromellitic acid, etc.) having 9 to 20 carbon atoms. Additionally, the polycarboxylic acid (2) may be selected from acid anhydrides or lower alkyl esters (methyl ester, ethyl ester, isopropyl ester, etc.) of the above-mentioned compounds and reacted with the polyol (1).

As for the proportion of the polyol (1) to the polycarboxylic acid (2), the equivalence ratio [OH]/[COOH] of the hydroxyl group [OH] to the carboxyl group [COOH] is normally in the range of 2/1 to 1/1, preferably in the range of 1.5/1 to 1/1, more preferably in the range of 1.3/1 to 1.02/1.

Examples of the polyisocyanate (3) include aliphatic polyisocyanates (tetramethylene diisocyanate, hexamethylene diisocyanate, 2,6-diisocyanatomethyl caproate, etc.); alicyclic polyisocyanates (isophorone diisocyanate, cyclohexylmethane diisocyanate, etc.); aromatic diisocyanates (tolylene diisocyanate, diphenylmethane diisocyanate, etc.); aromatic aliphatic diisocyanates ($\alpha,\alpha,\alpha',\alpha'$-tetramethylxylylene diisocyanate, etc.); isocyanurates; the polyisocyanates blocked with phenol derivatives, oximes, caprolactam, etc.; and combinations each composed of any two or more of these.

As for the proportion of the polyisocyanate (3) to the polyester, the equivalence ratio [NCO]/[OH] of the isocyanate group [NCO] to the hydroxyl group [OH] of the hydroxyl group-containing polyester is normally in the range of 5/1 to 1/1, preferably in the range of 4/1 to 1.2/1, more preferably in the range of 2.5/1 to 1.5/1. When the equivalence ratio [NCO]/[OH] is greater than 5, there is a decrease in low-temperature toner-fixing capability. When the isocyanate group [NCO] is less than 1 in molar ratio, the amount of urea contained in the modified polyester is small, so that there is a decrease in resistance to hot offset. The amount of components of the polyisocyanate (3) contained in the isocyanate-terminated prepolymer (A) is normally 0.5% by mass to 40% by mass, preferably 1% by mass to 30% by mass, more preferably 2% by mass to 20% by mass. When the amount is less than 0.5% by mass, there is a decrease in resistance to hot offset and there is a disadvantage in achieving a favorable balance between heat-resistant storageability and low-temperature toner-fixing capability. When the amount is greater than 40% by mass, there is a decrease in low-temperature toner-fixing capability.

The number of isocyanate groups contained per molecule in the isocyanate group-containing prepolymer (A) is normally 1 or more, preferably 1.5 to 3 on average, more preferably 1.8 to 2.5 on average. When the number thereof per molecule is less than 1 on average, the molecular weight of a urea-modified polyester is low, and thus there is a decrease in resistance to hot offset.

Examples of the amines (B) include diamines (B1), trivalent or higher polyamines (B2), amino alcohols (B3), amino mercaptans (B4), amino acids (B5), and compounds (B6) obtained by blocking amino groups of (B1) to (B5). Examples of the diamines (B1) include aromatic diamines (phenylenediamine, diethyltoluenediamine, 4,4'-diaminodiphenylmethane, etc.); alicyclic diamines (4,4'-diamino-3,3'-dimethyldicyclohexylmethane, diaminecyclohexane, isophoronediamine, etc.); and aliphatic diamines (ethylenediamine, tetramethylenediamine, hexamethylenediamine, etc.). Examples of the trivalent or higher polyamines (B2) include diethylenetriamine and triethylenetetramine. Examples of the amino alcohols (B3) include ethanolamine and hydroxyethylaniline. Examples of the amino mercaptans (B4) include aminoethyl mercaptan and aminopropyl mercaptan. Examples of the amino acids (B5) include aminopropionic acid and aminocaproic acid. Examples of the compounds (B6) include oxazoline compounds and ketimine compounds derived from the amines of (B1) to (B5) and ketones (acetone, methyl ethyl ketone, methyl isobutyl ketone, etc.). Among these amines (B), preference is given to the diamines (B1), and mixtures each composed of any of the diamines (B1) and a small amount of any of the trivalent or higher polyamines (B2).

Further, an elongation terminator may, if necessary, be used so as to adjust the molecular weight of a urea-modified polyester. Examples of the elongation terminator include monoamines (diethylamine, dibutylamine, butylamine, laurylamine, etc.), and compounds (ketimine compounds) obtained by blocking the monoamines.

As for the proportion of the amine (B), the equivalence ratio [NCO]/[NHx] of the isocyanate group [NCO] in the isocyanate group-containing prepolymer (A) to the amino group [NHx] in the amine (B) is normally in the range of 1/2 to 2/1, preferably in the range of 1.5/1 to 1/1.5, more preferably in the range of 1.2/1 to 1/1.2. When the equivalence ratio [NCO]/[NHx] is greater than 2 or less than 1/2, the molecular weight of a urea-modified polyester (i) is low, and thus there is a decrease in resistance to hot offset. In the present invention, the urea-modified polyester (i) may contain a urethane bond as well as a urea bond. The molar ratio of the amount of the urea bond to the amount of the urethane bond is normally in the range of 100/0 to 10/90, preferably in the range of 80/20 to 20/80, more preferably in the range of 60/40 to 30/70. When the urea bond is less than 10% in molar ratio, there is a decrease in resistance to hot offset.

By the above-mentioned reactions, a modified polyester, particularly the urea-modified polyester (i), used for the toner in the present invention can be produced. The urea-modified polyester (i) is produced by a one-shot method or a prepolymer method. The mass average molecular weight of the urea-modified polyester (i) is normally 10,000 or greater, preferably 20,000 to 10,000,000, more preferably 30,000 to 1,000,000. When it is less than 10,000, there is a decrease in resistance to hot offset. The number average molecular weight of the urea-modified polyester is not particularly limited when the after-mentioned unmodified polyester (ii) is additionally used; it may be such a number average molecular weight as helps obtain the above-mentioned mass average molecular weight. When the urea-modified polyester (i) is solely used, its number average molecular weight is normally 20,000 or less, preferably 1,000 to 10,000, more preferably 2,000 to 8,000. When it is greater than 20,000, there is a decrease in low-temperature toner-fixing capability and, if the urea-modified polyester (i) is used in a full-color apparatus, there is a decrease in glossiness.

Also in the present invention, instead of solely using the urea-modified polyester (i), an unmodified polyester (ii) may be additionally used as a binder resin component together with the urea-modified polyester (i). The use of the unmodified polyester (ii) together with the urea-modified polyester (i) is preferable to the use of the urea-modified polyester (i) alone because there is an increase in low-temperature toner-fixing capability and, if used in a full-color apparatus, there is an increase in glossiness. Examples of the unmodified polyester (ii) include a polycondensate of a polyol (1) and a polycarboxylic acid (2) similar to the components of the urea-modified polyester (i), and suitable examples thereof are also similar to those suitable for the urea-modified polyester (i). The polyester (ii) does not necessarily have to be an unmodified polyester and may be a polyester modified with a chemical bond other than urea bond, for example urethane bond. It is desirable in terms of low-temperature toner-fixing capability and resistance to hot offset that the urea-modified polyester (i) and the polyester (ii) be compatible with each other at least partially. Accordingly, it is desirable that the urea-modified polyester (i) and the polyester (ii) have similar compositions. When the polyester (ii) is used, the mass ratio of the urea-modified polyester (i) to the polyester (ii) is normally in the range of 5/95 to 80/20, preferably in the range of 5/95 to 30/70, more preferably in the range of 5/95 to 25/75, most preferably in the range of 7/93 to 20/80. When the mass ratio of the urea-modified polyester (i) is less than 5%, there is a decrease in resistance to hot offset and there is a disadvantage in achieving a favorable balance between heat-resistant storageability and low-temperature toner-fixing capability.

The peak molecular weight of the polyester (ii) is normally 1,000 to 30,000, preferably 1,500 to 10,000, more preferably 2,000 to 8,000. When it is less than 1,000, there is a decrease in heat-resistant storageability. When it is greater than 10,000, there is a decrease in low-temperature toner-fixing capability. The hydroxyl value of the polyester (ii) is preferably 5 or greater, more preferably 10 to 120, most preferably 20 to 80. When the hydroxyl value is less than 5, there is a disadvantage in achieving a favorable balance between heat-resistant storageability and low-temperature toner-fixing capability. The acid value of the polyester (ii) is normally 1 to 30, preferably 5 to 20. With such an acid value, the polyester (ii) tends to be easily negatively charged.

In the present invention, the glass transition temperature (Tg) of the binder resin is normally 50° C. to 70° C., preferably 55° C. to 65° C. If it is lower than 50° C., blocking worsens when the toner is stored at a high temperature. If it is higher than 70° C., the low-temperature toner-fixing capability is insufficient. Due to the presence of the urea-modified polyester together with the unmodified polyester, the dry toner in the present invention tends to be superior in heat-resistant storageability to known polyester toners even if the glass transition temperature is low. As for the storage elastic modulus of the binder resin, the temperature (TG') at which it is 10,000 dyne/cm$^2$, at a measurement frequency of 20 Hz, is normally 100° C. or higher, preferably 110° C. to 200° C. When the temperature is lower than 100° C., there is a decrease in resistance to hot offset. As for the viscosity of the binder resin, the temperature (Tη) at which it is 1,000 P, at a measurement frequency of 20 Hz, is normally 180° C. or lower, preferably 90° C. to 160° C. When the temperature is higher than 180° C., there is a decrease in low-temperature toner-fixing capability. Accordingly, it is desirable in terms of a balance between low-temperature toner-fixing capability and resistance to hot offset that TG' be higher than Tη. In other words, the difference (TG'−Tη) between TG' and Tη is desirably 0° C. or greater. It is more desirably 10° C. or greater, most desirably 20° C. or greater. The upper limit of the difference between TG' and Tη is not particularly limited. Also, it is desirable in terms of a balance between heat-resistant storageability and low-temperature toner-fixing capability that the difference between Tη and Tg be 0° C. to 100° C. It is more desirably 10° C. to 90° C., most desirably 20° C. to 80° C.

The binder resin can be produced by the following method or the like. A polyol (1) and a polycarboxylic acid (2) are heated to a temperature of 150° C. to 280° C. in the presence of a known esterifying catalyst such as tetrabutoxy titanate or dibutyltin oxide, then water produced is distilled away, with a reduction in pressure if necessary, and a hydroxyl group-containing polyester is thus obtained. Subsequently, the polyester is reacted with a polyisocyanate (3) at a temperature of 40° C. to 140° C. so as to obtain an isocyanate group-containing prepolymer (A). Further, the prepolymer (A) is reacted with an amine (B) at a temperature of 0° C. to 140° C. so as to obtain a urea-modified polyester. When the polyester is reacted with the polyisocyanate (3) and when the prepolymer (A) is reacted with the amine (B), solvent may be used if necessary. Examples of usable solvents include aromatic solvents (toluene, xylene, etc.), ketones (acetone, methyl ethyl ketone, methyl isobutyl ketone, etc.), esters (ethyl acetate, etc.), amides (dimethylformamide, dimethylacetamide, etc.) and ethers (tetrahydrofuran, etc.), which are inactive to the polyisocyanate (3). In the case where a polyester (ii) which is not modified with a urea bond is additionally used, the polyester (ii) is produced in a manner similar to the production of the hydroxyl group-containing polyester, and the polyester (ii) is dissolved and mixed in a solution of the above-mentioned urea-modified polyester (i) in which reaction has finished.

Broadly, the toner used in the present invention can be produced by the following method. It should, however, be noted that other methods may be employed instead.

The aqueous medium used in the present invention may be composed solely of water or composed of water and a solvent miscible with water. Examples of the solvent miscible with water include alcohols (methanol, isopropanol, ethylene glycol, etc.), dimethylformamide, tetrahydrofuran, cellusolves (methyl cellusolve, etc.) and lower ketones (acetone, methyl ethyl ketone, etc.).

Toner particles may be formed in the aqueous medium by reaction between the amine (B) and a dispersion element made of the isocyanate group-containing prepolymer (A) or by using the urea-modified polyester (i) produced in advance. As a method for stably forming the dispersion element made of the prepolymer (A) and/or the urea-modified polyester (i) in the aqueous medium, there is, for example, a method of adding a toner material composition which includes the prepolymer (A) or the urea-modified polyester (i) into the aqueous medium and dispersing the composition by shearing force. The prepolymer (A) and other toner components (hereinafter referred to as "toner materials") such as a colorant, a colorant master batch, a releasing agent, a charge controlling agent and an unmodified polyester resin may be mixed together when the dispersion element is formed in the aqueous medium; it is, however, more desirable to mix the toner materials together in advance, then add and disperse the mixture into the aqueous medium. Also in the present invention, the other toner materials such as a colorant, a releasing agent and a charge controlling agent do not necessarily have to be mixed when the particles are formed in the aqueous medium; the other toner materials may be added after the particles have been formed. For instance, a colorant may be added in accordance with a known dyeing method after particles not containing a colorant have been formed.

Although not particularly limited, the dispersing method may be selected from known methods such as low-speed shearing dispersion, high-speed shearing dispersion, frictional dispersion, high-pressure jet dispersion and ultrasonic dispersion. To make the dispersion element have a particle diameter of 2 μm to 20 μm, high-speed shearing dispersion is preferable. In the case where a high-speed shearing dispersing machine is used, the rotational speed is, although not particularly limited, normally 1,000 rpm to 30,000 rpm, preferably 5,000 rpm to 20,000 rpm. Although not particularly limited, the length of time for which the dispersion lasts is normally 0.1 min to 5 min when a batch method is employed. The temperature at the time of dispersion is normally 0° C. to 150° C. (under pressure), preferably 40° C. to 98° C. High temperatures are preferable in that the dispersion element made of the prepolymer (A) and/or the urea-modified polyester (i) is low in viscosity and thus the dispersion can be facilitated.

The amount of the aqueous medium used is normally 50 parts by mass to 2,000 parts by mass, preferably 100 parts by mass to 1,000 parts by mass, per 100 parts by mass of the toner composition which includes the prepolymer (A) and/or the urea-modified polyester (i). When the amount is less than 50 parts by mass, the toner composition is in a poorly dispersed state, and thus toner particles having a predetermined diameter cannot be obtained. When the amount is greater than 20,000 parts by mass, it is not desirable from an economical point of view. Additionally, a dispersant may be used if necessary. Use of a dispersant is preferable in that the particle size distribution becomes sharper and the dispersion can be stabilized.

As to a process of synthesizing the urea-modified polyester (i) from the prepolymer (A), the amine (B) may be added for reaction, before the toner composition is dispersed in the aqueous medium; alternatively, the amine (B) may be added after the toner composition has been dispersed in the aqueous medium, thus allowing reaction to occur from particle interfaces. In this case, the urea-modified polyester may be preferentially formed on the surface of the toner produced, and a concentration gradient may be thus provided inside toner particles.

Examples of a dispersant for emulsifying or dispersing in a water-containing liquid an oily phase in which a toner composition is dispersed include anionic surfactants such as alkylbenzene sulfonates, α-olefin sulfonates and phosphoric acid esters; amine salt-based cationic surfactants such as alkylamine salts, aminoalcohol fatty acid derivatives, polyamine fatty acid derivatives and imidazoline; quaternary ammonium salt-based cationic surfactants such as alkyltrimethyl ammonium salts, dialkyl dimethyl ammonium salts, alkyl dimethyl benzyl ammonium salts, pyridinium salts, alkyl isoquinolinium salts and benzetonium chloride; nonionic surfactants such as fatty acid amide derivatives and polyhydric alcohol derivatives; and amphoteric surfactants such as alanine, dodecyldi(aminoethyl)glycine, di(octylaminoethyl) glycine and N-alkyl-N,N-dimethylammoniumbetaine.

Use of a fluoroalkyl group-containing surfactant makes it possible to produce its effects even when used in very small amounts. Suitable examples of fluoroalkyl group-containing anionic surfactants include fluoroalkyl carboxylic acids having 2 to 10 carbon atoms, and metal salts thereof, disodium perfluorooctanesulfonylglutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propanesulfonate, fluoroalkyl (C11 to C20) carboxylic acids and metal salts thereof, perfluoroalkylcarboxylic acids (C7 to C13) and metal salts thereof, perfluoroalkyl (C4 to C12) sulfonic acids and metal salts thereof, perfluorooctanesulfonic acid diethanolamide, N-propyl-N-(2-hydroxyethyl) perfluorooctanesulfonamide, perfluoroalkyl (C6 to C10) sulfonamide propyltrimethylammonium salts, perfluoroalkyl (C6 to C10)-N-ethylsulfonylglycine salts and monoperfluoroalkyl (C6 to C16) ethyl phosphoric acid esters.

Examples of fluoroalkyl group-containing anionic surfactants as products include SURFLON S-111, S-112 and S-113 (produced by Asahi Glass Co., Ltd.); FLUORAD FC-93, FC-95, FC-98 and FC-129 (produced by Sumitomo 3M Limited); UNIDYNE DS-101 and DS-102 (produced by DAIKIN INDUSTRIES, LTD.); MEGAFAC F-110, F-120, F-113, F-191, F-812 and F-833 (produced by Dainippon Ink And Chemicals, Incorporated); ECTOP EF-102, 103, 104, 105, 112, 123A, 123B, 306A, 501, 201 and 204 (produced by Tochem Products Co., Ltd.); and FTERGENT F-100 and F150 (produced by NEOS COMPANY LIMITED).

Examples of cationic surfactants include fluoroalkyl group-containing aliphatic primary, secondary or tertiary amine acids, aliphatic quaternary ammonium salts such as perfluoroalkyl (C6 to C10) sulfonamide propyltrimethylammonium salts, benzalkonium salts, benzetonium chloride, pyridinium salts and imidazolinium salts. Examples of cationic surfactants as products include SURFLON S-121 (produced by Asahi Glass Co., Ltd.), FLUORAD FC-135 (produced by Sumitomo 3M Limited), UNIDYNE DS-202 (produced by DAIKIN INDUSTRIES, LTD.), MEGAFAC F-150 and F-824 (produced by Dainippon Ink And Chemicals, Incorporated), ECTOP EF-132 (produced by Tochem Products Co., Ltd.), and FTERGENT F-300 (produced by NEOS COMPANY LIMITED).

Also, as inorganic compound dispersants sparingly soluble in water, tricalcium phosphate, calcium carbonate, titanium oxide, colloidal silica, hydroxyappetite and the like may be used.

A polymeric protective colloid may be added to stabilize dispersion droplets. Examples thereof include acids such as acrylic acid, methacrylic acid, α-cyanoacrylic acid, α-cyanomethacrylic acid, itaconic acid, crotonic acid, fumaric acid, maleic acid and maleic anhydride; hydroxyl group-containing (meth)acrylic monomers such as acrylic acid β-hydroxyethyl, methacrylic acid β-hydroxyethyl, acrylic acid β-hydroxypropyl, methacrylic acid β-hydroxypropyl, acrylic acid γ-hydroxypropyl, methacrylic acid γ-hydroxypropyl, acrylic acid-3-chloro-2-hydroxypropyl, methacrylic acid-3-chloro-2-hydroxypropyl, diethyleneglycolmonoacrylic acid esters, diethyleneglycolmonomethacrylic acid esters, glycerinmonoacrylic acid esters, glycerinmonomethacrylic acid esters, N-methylolacrylamide and N-methylolmethacrylamide; vinyl alcohol and ethers of vinyl alcohol such as vinyl methyl ether, vinyl ethyl ether and vinyl propyl ether; esters of carboxyl group-containing compounds and vinyl alcohol such as vinyl acetate, vinyl propionate and vinyl butyrate; acrylamide, methacrylamide, diacetone acrylamide, and methylol compounds thereof; acid chlorides such as acrylic acid chloride and methacrylic acid chloride; homopolymers and copolymers of nitrogen-containing compounds such as vinyl pyridine, vinyl pyrolidone, vinyl imidazole and ethyleneimine, and of these nitrogen-containing compounds each having a heterocyclic ring; polyoxyethylene-based compounds such as polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester and polyoxyethylene nonyl phenyl ester; and celluloses such as methyl cellulose, hydroxyethyl cellulose and hydroxypropyl cellulose.

In the case where a substance soluble in acid and/or alkali, such as a calcium phosphate salt, is used as a dispersion stabilizer, the substance is dissolved in an acid, e.g. hydrochloric acid, then the substance is removed from fine particles, for example by washing with water. Besides, its removal is enabled by a process such as decomposition brought about by an enzyme.

In the case where the dispersant is used, the dispersant may remain on the toner particle surface; it is, however, preferable in terms of toner chargeability to remove the dispersant by washing after elongation and/or cross-linkage.

Further, to reduce the viscosity of the toner composition, a solvent may be used in which the urea-modified polyester (i) and/or the prepolymer (A) are/is soluble. Use of the solvent is preferable in that the particle size distribution becomes sharper. Examples of the solvent include toluene, xylene, benzene, carbon tetrachloride, methylene chloride, 1,2-dichloroethane, 1,1,2-trichloroethane, trichloroethylene, chloroform, monochloro benzene, dichloroethylidene, methyl acetate, ethyl acetate, methyl ethyl ketone and methyl isobutyl ketone. These may be used individually or in combination. Suitable examples thereof include aromatic solvents such as toluene and xylene, and halogenated hydrocarbons such as methylene chloride, 1,2-dichloroethane, chloroform and carbon tetrachloride, particularly aromatic solvents such as toluene and xylene. The amount of the solvent used is normally 0 parts by mass to 300 parts by mass, preferably 0 parts by mass to 100 parts by mass, more preferably 25 parts by mass to 70 parts by mass, per 100 parts by mass of the prepolymer (A). In the case where the solvent is used, it is removed by heating under normal or reduced pressure after elongation and/or cross-linkage.

The length of time for which the elongation and/or the cross-linkage last(s) is selected according to the reactivity between the isocyanate group structure of the prepolymer (A) and the amine (B) and is normally in the range of 10 min to 40 hr, preferably in the range of 2 hr to 24 hr. The reaction temperature is normally in the range of 0° C. to 150° C., preferably in the range of 40° C. to 98° C. Additionally, a known catalyst may be used if necessary. Specific examples thereof include dibutyltin laurate and dioctyltin laurate.

To remove an organic solvent from the emulsified dispersion element obtained, a method can be employed in which the entire system is gradually increased in temperature and the organic solvent in droplets is completely removed by evaporation. Alternatively, by spraying the emulsified dispersion element into a dry atmosphere and completely removing a water-insoluble organic solvent in droplets, fine toner particles can be formed, and also, an aqueous dispersant can be removed by evaporation. Generally, examples of the dry atmosphere into which the emulsified dispersion element is sprayed include gases such as air, nitrogen, carbonic acid gas and combustion gas which have been heated, especially flow of gasses heated to a temperature higher than or equal to the boiling point of the solvent used that has the highest boiling point. A dry atmosphere of highly desired quality can be obtained by a short-time process with a spray dryer, a belt dryer, a rotary kiln or the like.

In the case where there is a wide particle size distribution at the time of emulsification and dispersion, and washing and drying processes are carried out with the particle size distribution kept unchanged, it is possible to adjust the particle size distribution such that particles are classified according to a desired particle size distribution.

As to the classification, fine particles can be removed by a cyclone separator, a decanter, a centrifuge, etc. in liquid. The classification may, of course, be carried out after particles have been obtained as powder through drying; nevertheless, it is desirable in terms of efficiency that the classification be carried out in liquid. Unnecessary fine or coarse particles produced may be returned to a kneading process again so as to be used for formation of particles. In this case, the fine or coarse particles may be in a wet state.

It is desirable that the dispersant used be removed from the obtained dispersion solution as much as possible and at the same time as the classification.

By mixing the obtained dried toner powder with different particles such as releasing agent fine particles, charge controlling fine particles, fluidizer fine particles and colorant fine particles and mechanically impacting the mixed powder, the different particles are fixed to and fused with the particle surface and thus it is possible to prevent detachment of the different particles from the surface of the composite particles obtained.

As specific means of performing the foregoing, there are, for example, a method of impacting the mixture, using a blade which rotates at high speed, and a method of pouring the mixture into a high-speed gas flow, accelerating the speed of the mixture and allowing particles to collide with one another or composite particles to collide with a certain plate. Examples of apparatuses for performing the foregoing include apparatuses in which the pulverization air pressure is reduced, made by modifying I-TYPE MILL (manufactured by Nippon Pneumatic Mfg. Co., Ltd.) and ANGMILL (manufactured by Hosokawa Micron Group); HYBRIDIZATION SYSTEM (manufactured by NARA MACHINERY CO., LTD.); KRYPTRON SYSTEM (manufactured by Kawasaki Heavy Industries, Ltd.); and automatic mortars.

Examples of the colorant used for the toner include pigments and dyes conventionally used as colorants for toners. Specific examples thereof include carbon black, lamp black, iron black, ultramarine, nigrosine dyes, aniline blue, phthalocyanine blue, phthalocyanine green, Hansa Yellow G, Rhodamine 6C Lake, chalco oil blue, chrome yellow, quinacridone red, benzidine yellow and rose bengal. These may be used individually or in combination.

Further, if necessary, magnetic components, for example iron oxides such as ferrite, magnetite and maghemite, metals such as iron, cobalt and nickel, and alloys composed of these and other metals, may be included individually or in combination in toner particles in order for the toner particles themselves to have magnetic properties. Also, these components may be used (also) as colorant components.

Also, the number average particle diameter of the colorant in the toner used in the present invention is preferably 0.5 μm or less, more preferably 0.4 μm or less, even more preferably 0.3 μm or less.

When the number average particle diameter of the colorant in the toner is greater than 0.5 μm, the dispersibility of the pigment is insufficient, and thus favorable transparency cannot be obtained in some cases.

When the colorant has a very small particle diameter of less than 0.1 μm, it is far smaller than the half wavelength of visible light; thus, it is thought that the colorant does not have an adverse effect on light-reflecting and -absorbing properties. Therefore, colorant particles which are less than 0.1 μm in diameter contribute to favorable color reproducibility and transparency of an OHP sheet with a fixed image. Meanwhile, when there are many colorant particles which are greater than 0.5 μm in diameter, transmission of incident light is disturbed and/or the incident light is scattered, and thus a projected image on an OHP sheet tends to decrease in brightness and vividness.

Also, the presence of many colorant particles which are greater than 0.5 μm in diameter is not favorable because the colorant particles easily detach from the toner particle surface, causing problems such as fogging, smearing of the drum and cleaning failure. It should be particularly noted that colorant particles which are greater than 0.7 μin diameter preferably occupy 10% by number or less, more preferably 5% by number or less, of all colorant particles.

Also, by kneading the colorant together with part or all of a binder resin in advance with the addition of a wetting liquid, the colorant and the binder resin are sufficiently attached to each other at an early stage, the colorant is effectively dispersed in toner particles in a subsequent toner producing process, the dispersed particle diameter of the colorant becomes small, and thus more favorable transparency can be obtained.

For the binder resin kneaded together with the colorant in advance, any of the resins shown above as examples of binder resins for the toner can be used without the need to change it; it should, however, be noted that the binder resin is not limited to the resins.

As a specific method of kneading a mixture of the colorant and the binder resin in advance with the addition of the wetting liquid, there is, for example, a method in which the colorant, the binder resin and the wetting liquid are mixed together using a blender such as a Henschel mixer, then the obtained mixture is kneaded at a temperature lower than the melting temperature of the binder resin, using a kneading machine such as a two-roll machine or three-roll machine, and a sample is thus obtained.

For the wetting liquid, an ordinary one may be used, considering the solubility of the binder resin and the wettability thereof with the colorant; water and organic solvents such as acetone, toluene and butanone are favorable in terms of the colorant's dispersibility.

Among them, use of water is particularly favorable in view of care for the environment and maintenance of the colorant's dispersion stability in the subsequent toner producing process.

With this production method, colorant particles contained in the obtained toner are small in diameter, and also, the particles are in a highly uniform dispersed state, so that the color reproducibility of an image projected by an OHP can be further improved.

Additionally, as long as the structure of the present invention is employed, a releasing agent typified by wax may be contained along with the binder resin and the colorant in the toner.

For the releasing agent, a known releasing agent may be used, and examples thereof include polyolefin waxes (polyethylene wax, polypropylene wax, etc.), long-chain hydrocarbons (paraffin wax, Sasolwax, etc.), and carbonyl group-containing waxes.

Among these, carbonyl group-containing waxes are preferable. Examples thereof include polyalkanoic acid esters (carnauba wax, montan wax, trimethylolpropane tribehenate, pentaerythritol tetrabehenate, pentaerythritol diacetate dibehenate, glycerin tribehenate, 1,18-octadecanediol distearate, etc.), polyalkanol esters (tristearyl trimellitate, distearyl maleate, etc.), polyalkanoic acid amides (ethylenediamine dibehenyl amide, etc.), polyalkylamides (trimellitic acid tristearyl amide, etc.), and dialkyl ketones (distearyl ketone, etc.).

Among these carbonyl group-containing waxes, preference is given to polyalkanoic acid esters. The melting point of the releasing agent is normally 40° C. to 160° C., preferably 50° C. to 120° C., more preferably 60° C. to 90° C. Waxes which are lower than 40° C. in melting point have an adverse effect on heat-resistant storageability, and waxes which are higher than 160° C. in melting point are likely to cause cold offset when toner is fixed at a low temperature. The melt viscosity of each wax is preferably 5 cps to 1,000 cps, more preferably 10 cps to 100 cps, when measured at a temperature higher than the melting point by 20° C. Waxes which are higher than 1,000 cps in melt viscosity are not much effective in improving low-temperature toner-fixing capability and resistance to hot offset. The amount of wax contained in the toner is normally 0% by mass to 40% by mass, preferably 3% by mass to 30% by mass.

Additionally, to adjust the charged amount of the toner and allow toner particles to rise quickly upon charging, a charge controlling agent may be contained in the toner if necessary. Here, if a colored material is used as the charge controlling agent, there is a change in color, so that use of a material which is colorless or whitish is preferable.

The charge controlling agent may be selected from known charge controlling agents. Examples thereof include triphenylmethane-based dyes, molybdic acid chelate pigments, rhodamine-based dyes, alkoxy amines, quaternary ammonium salts (including fluorine-modified quaternary ammonium salts), alkylamides, phosphorus and compounds thereof, tungsten and compounds thereof, fluorine-based activating agents, metal salts of salicylic acid and metal salts of salicylic acid derivatives. Specific examples thereof include BONTRON P-51 as a quaternary ammonium salt, E-82 as an oxynaphthoic acid-based metal complex, E-84 as a salicylic acid-based metal complex, and E-89 as a phenolic condensate (which are produced by Orient Chemical Industries); TP-302 and TP-415 as quaternary ammonium salt molybdenum complexes (which are produced by Hodogaya Chemical Industries); COPY CHARGE PSY VP2038 as a quaternary ammonium salt, COPY BLUE PR as a triphenylmethane derivative, and COPY CHARGE NEG VP2036 and COPY CHARGE NX VP434 as quaternary ammonium salts (which are produced by Hoechst); LRA-901, and LR-147 as a boron complex (which are produced by Japan Carlit Co., Ltd.); quinacridone, azo-based pigments; and polymeric compounds containing functional groups such as sulfonic acid group, carboxyl group and quaternary ammonium salt.

In the present invention, the amount of the charge controlling agent used is decided according to the type of the binder resin, the presence or absence of additive(s) used if necessary, and the toner producing method including the dispersing method and so not unequivocally limited; however, the amount is in the range of 0.1 parts by mass to 10 parts by mass, preferably in the range of 0.2 parts by mass to 5 parts by mass, per 100 parts by mass of the binder resin. When the amount is greater than 10 parts by mass per 100 parts by mass of the binder resin, the chargeability of the toner is so great that effects of the charge controlling agent are reduced, and there is an increase in electrostatic suction toward a developing roller, causing a decrease in the fluidity of a developer and a decrease in image density. Such a charge controlling agent may be dissolved and dispersed in the toner after melted and kneaded together with a master batch and a resin, or may be directly added into an organic solvent when dissolved and dispersed therein, or may be fixed on the toner particle surface after the formation of toner particles.

When the toner composition is dispersed in the aqueous medium in the toner producing process, fine resin particles mainly for stabilizing the dispersion may be added.

For the fine resin particles, any resin (including thermoplastic resin and thermosetting resin) may be used as long as it is capable of forming an aqueous dispersion element. Examples thereof include vinyl resins, polyurethane resins, epoxy resins, polyester resins, polyamide resins, polyimide resins, silicon resins, phenol resins, melamine resins, urea resins, aniline resins, ionomer resins and polycarbonate resins. For the fine resin particles, any two or more of these resins may be used in combination. Among these resins, preference is given to vinyl resins, polyurethane resins, epoxy resins, polyester resins, and combinations thereof because an aqueous dispersion element of fine spherical resin particles can be easily obtained.

As the vinyl resins, polymers each produced by homopolymerizing or copolymerizing a vinyl monomer are used. Examples thereof include, but are not limited to, styrene-(meth)acrylic acid ester copolymers, styrene-butadiene copolymers, (meth)acrylic acid-acrylic acid ester copolymers, styrene-acrylonitrile copolymers, styrene-maleic anhydride copolymers and styrene-(meth)acrylic acid copolymers.

Further, fine inorganic particles can be favorably used as an external additive to support the developability and chargeability of toner particles.

The fine inorganic particles preferably have a primary particle diameter of 0.005 μm to 2 μm each, more preferably 0.005 μm to 0.5 μm each. Also, the fine inorganic particles preferably have a BET specific surface area of 20 $m^2/g$ to 500 $m^2/g$. The fine inorganic particles used preferably occupy 0.01% by mass to 5% by mass, more preferably 0.01% by mass to 2.0% by mass, of the toner. Specific examples of the fine inorganic particles include silica, alumina, titanium oxide, barium titanate, magnesium titanate, calcium titanate, strontium titanate, zinc oxide, tin oxide, silica sand, clay, mica, wollastonite, diatom earth, chrome oxide, cerium oxide, red ochre, antimony trioxide, magnesium oxide, zirconium oxide, barium sulfate, barium carbonate, calcium carbonate, silicon carbide and silicon nitride.

Besides, specific examples thereof include fine polymeric particles exemplified by polymer particles of thermosetting resins, polycondensates such as nylons, benzoguanamine and silicones, acrylic acid ester copolymers, methacrylic acid esters and polystyrene obtained by soap-free emulsion polymerization, suspension polymerization or dispersion polymerization.

Such a fluidizer subjects the toner particles to surface treatment and increases their hydrophobicity, thereby making it possible to prevent a decrease in the fluidity and chargeability of the toner particles even at high humidity. Suitable examples thereof as surface-treating agents include silane coupling agents, silylating agents, fluorinated alkyl group-containing silane coupling agents, organic titanate-based coupling agents, aluminum-based coupling agents, silicone oils and modified silicone oils.

Examples of a cleanability enhancer for removing a developer which remains on a photoconductor or a primary transfer medium after image transfer include fatty acid metal salts such as zinc stearate, calcium stearate and stearic acid, and fine polymer particles produced by soap-free emulsion polymerization or the like, such as fine polymethyl methacrylate particles and fine polystyrene particles. The fine polymer particles have a relatively narrow particle size distribution, and those which are 0.01 μm to 1 μm in volume average particle diameter are preferable.

Use of such a toner makes it possible to form a high-quality toner image superior in stability when developed, as described above. However, toner particles which remain on the image bearing member, not having been transferred by a transfer device onto a transfer medium or an intermediate transfer medium, may possibly pass through a gap between the image bearing member and a cleaning device because the fineness and superior transferability of the toner particles make it difficult for the cleaning device to remove them. To remove the toner particles completely from the image bearing member, it is necessary to press a toner removing member such as a cleaning blade against the image bearing member with strong force. Such a load not only shortens the lifetimes of the image bearing member and the cleaning device but also contributes to consumption of extra energy.

In the case where the load on the image bearing member is reduced, removal of the toner particles and small-diameter carrier particles on the image bearing member is insufficient, and these particles do damage to the surface of the image bearing member when passing through the cleaning device, and thereby cause variation in the performance of the image forming apparatus.

As described above, since the image forming apparatus of the present invention is superior in terms of permissible ranges with respect to variation in the surface state of the image bearing member, especially with respect to the existence of low-resistance site(s), and has a structure in which variation in charging performance to the image bearing member, etc. is highly reduced, use of the image forming apparatus and the above-mentioned toner together makes it possible to stably obtain images of very high quality over a long period of time.

Also, it goes without saying that the image forming apparatus of the present invention can be used with a pulverized toner having an indefinite particle shape as well as with the above-mentioned toner suitable for obtaining high-quality images, and the lifetime of the apparatus can be greatly lengthened.

As the material for such a pulverized toner, any material usually used for electrophotographic toner can be used without any limitation in particular.

Examples of ordinary binder resins used for the pulverized toner include, but are not limited to, homopolymers of styrene and its substitution products, such as polystyrene, poly-p-chlorostyrene and polyvinyl toluene; styrene copolymers such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chlormethacrylate copolymers, styrene-acrylonitrile copolymers, styrene-vinyl methyl ketone copolymers, styrene-butadiene copolymers, styrene-isoprene copolymers and styrene-maleic acid copolymers; homopolymers and copolymers of acrylic acid esters, such as polymethyl acrylate, polybutyl acrylate, polymethyl methacrylate and polybutyl methacrylate; polyvinyl derivatives such as polyvinyl chloride and polyvinyl acetate; polyester polymers, polyurethane polymers, polyamide polymers, polyimide polymers, polyol polymers, epoxy polymers, terpene polymers, aliphatic or alicyclic hydrocarbon resins and aromatic petroleum resins. These may be used individually or in combination. It is particularly desirable in terms of electrical property, cost, etc. that the material be at least one selected from the group consisting of styrene-acrylic copolymer resins, polyester resins and polyol resins. Use of polyester resins and/or polyol resins is even more desirable because of their favorable toner-fixing properties.

Additionally, for the above-mentioned reason, resin component(s) contained in a coating layer on the image bearing member, which is/are the same as the resin component(s) constituting the binder resin of the toner, is/are preferably at least one selected from linear polyester resin compositions, linear polyol resin compositions, linear styrene-acrylic resin compositions, and cross-linked products thereof.

As to the pulverized toner, for example, the resin component(s) is/are mixed with the above-mentioned colorant component(s), wax component(s) and charge controlling component(s) in advance if necessary, then they are kneaded at a temperature lower than or equal to a temperature in the vicinity of the melting temperature of the resin component(s), the mixture is cooled and then subjected to a pulverizing and classifying process, and the toner is thus produced; additionally, the above-mentioned externally added component(s) may be suitably added and mixed therewith if necessary.

What is claimed is:

1. An image-bearing member protecting agent used in an image forming method which includes applying or attaching the agent onto a surface of an image bearing member, the agent comprising:

a fatty acid metal salt; and boron nitride, wherein the boron nitride is crystals having an average diameter of 0.1 μm to 1.0 μm and forms secondary particles of a crystal aggregate having an average diameter of 3.0 μm to 14.0 μm.

2. The image-bearing member protecting agent according to claim 1, wherein the fatty acid metal salt is zinc stearate.

3. An image forming apparatus comprising:

an image bearing member which bears a toner image;

a transfer device configured to transfer the toner image borne on the image bearing member onto a transfer medium; and a protective layer forming device configured to apply or attach an image-bearing member protecting agent onto a surface of the image bearing member, after the toner image has been transferred onto the transfer medium, wherein the agent comprises a fatty acid metal salt and boron nitride, wherein the boron nitride is crystals having an average diameter of 0.1 μm to 1.0 μm and forms secondary particles of a crystal aggregate having an average diameter of 3.0 μm to 14.0 μm.

4. The image forming apparatus according to claim 3, further comprising a cleaning device placed on a downstream side of the transfer device and on an upstream side of the protective layer forming device with respect to the rotational direction of the image bearing member and configured to remove toner which remains on the surface of the image bearing member from the surface by rubbing against the surface.

5. The image forming apparatus according to claim 3, wherein at least a layer formed as the outermost surface of the image bearing member contains a thermosetting resin.

6. The image forming apparatus according to claim 3, wherein the image bearing member is a photoconductor.

7. The image forming apparatus according to claim 5, further comprising a charging device placed in contact with or close to the surface of the image bearing member.

8. The image forming apparatus according to claim 7, further comprising a voltage applying device configured to apply to the charging device a voltage which includes an alternating-current component.

9. The image forming apparatus according to claim 3, wherein the image bearing member is an intermediate transfer medium.

10. The image forming apparatus according to claim 3, wherein a circularity SR of the toner is in the range of 0.93 to 1.00, wherein the circularity SR of the toner is calculated in accordance with an Equation 1:

Circularity SR=Circumferential length of circle having the same area as projected particle area/Circumferential length of projected particle image (Equation 1).

11. The image forming apparatus according to claim 3, wherein a ratio $D_4/D_1$ of a weight average particle diameter $D_4$ of the toner to a number average particle diameter $D_1$ of the toner is in the range of 1.00 to 1.40.

12. A process cartridge comprising:

an image bearing member which bears a toner image; and a protective layer forming device provided integrally with the image bearing member and configured to apply or attach an image-bearing member protecting agent onto a surface of the image bearing member after the toner image has been transferred onto a transfer medium, wherein the agent comprises a fatty acid metal salt and boron nitride, wherein the boron nitride is crystals having an average diameter of 0.1 μm to 1.0 μm and forms secondary particles of a crystal aggregate having an average diameter of 3.0 μm to 14.0 μm.

13. The process cartridge according to claim 12, further comprising a cleaning device placed on an upstream side of the protective layer forming device with respect to the rotational direction of the image bearing member and configured to remove toner which remains on the surface of the image bearing member from the surface by rubbing against the surface.

14. The process cartridge according to claim 12, wherein at least a layer formed as the outermost surface of the image bearing member contains a thermosetting resin.

15. The process cartridge according to claim 12, further comprising a charging device placed in contact with or close to the surface of the image bearing member.

16. The process cartridge according to claim 12, wherein a circularity SR of the toner is in the range of 0.93 to 1.00, wherein the circularity SR of the toner is calculated in accordance with an Equation 1:

Circularity SR=Circumferential length of circle having the same area as projected particle area/Circumferential length of projected particle image (Equation 1).

17. The process cartridge according to claim 12, wherein a ratio $D_4/D_1$ of a weight average particle diameter $D_4$ of the toner to a number average particle diameter $D_1$ of the toner is in the range of 1.00 to 1.40.

* * * * *